US009203140B2

(12) United States Patent
Yong et al.

(10) Patent No.: US 9,203,140 B2
(45) Date of Patent: Dec. 1, 2015

(54) MULTI-BAND FRAME ANTENNA

(71) Applicant: SONY MOBILE COMMUNICATIONS JAPAN, INC., Tokyo (JP)

(72) Inventors: Check Chin Yong, Tokyo (JP); Minh-Chau Huynh, Tokyo (JP)

(73) Assignees: Sony Corporation, Tokyo (JP); SONY MOBILE COMMUNICATIONS INC., Tokyo (JP)

( * ) Notice: Subject to any disclaimer, the term of this patent is extended or adjusted under 35 U.S.C. 154(b) by 245 days.

(21) Appl. No.: 13/962,539

(22) Filed: Aug. 8, 2013

(65) Prior Publication Data

US 2014/0062801 A1 Mar. 6, 2014

Related U.S. Application Data

(60) Provisional application No. 61/695,198, filed on Aug. 30, 2012.

(51) Int. Cl.

| | |
|---|---|
| ***H01Q 1/24*** | (2006.01) |
| ***H01Q 1/42*** | (2006.01) |
| ***H01Q 1/48*** | (2006.01) |
| ***H01Q 9/04*** | (2006.01) |
| ***H01Q 9/42*** | (2006.01) |
| ***H01Q 13/16*** | (2006.01) |
| ***H01Q 5/30*** | (2015.01) |

(52) U.S. Cl.

CPC ..... *H01Q 1/243* (2013.01); *H01Q 1/42* (2013.01); *H01Q 1/48* (2013.01); *H01Q 5/30* (2015.01); *H01Q 9/0464* (2013.01); *H01Q 9/42* (2013.01); *H01Q 13/16* (2013.01)

(58) Field of Classification Search

USPC ..... 343/700 MS, 702, 866

See application file for complete search history.

(56) References Cited

U.S. PATENT DOCUMENTS

| | | | | |
|---|---|---|---|---|
| 2010/0123632 | A1 | 5/2010 | Hill et al. | |
| 2011/0001673 | A1 * | 1/2011 | You et al. | 343/702 |
| 2012/0157175 | A1 * | 6/2012 | Golko et al. | 455/575.7 |

FOREIGN PATENT DOCUMENTS

| | | |
|---|---|---|
| JP | 11-355022 | 12/1999 |
| JP | 2003-8321 | 1/2003 |

OTHER PUBLICATIONS

U.S. Appl. No. 14/476,048, filed Sep. 3, 2014, Yong.

The Extended European Search Report issued Nov. 27, 2013, in Application No. / Patent No. 13180674.7-1812.

* cited by examiner

*Primary Examiner* — Tan Ho

(74) *Attorney, Agent, or Firm* — Oblon, McClelland, Maier & Neustadt, L.L.P.

(57) ABSTRACT

A multi-band frame antenna to be used for LTE, MIMO, and other frequency bands. The frame antenna includes two main parts: a metallic frame with no gaps or discontinuities, and a conductive block. The outer perimeter of the metallic frame surrounds the conductive block, and there is a gap between the metallic frame and the conductive block. The conductive block is connected to a system ground. One or more antenna feeds are routed across the gap, between the metallic frame and the conductive block. One or more electrically shorted connections may also be made across the gap, between the metallic frame and the conductive block.

19 Claims, 35 Drawing Sheets

| | Free Space | |
|---|---|---|
| | Imbalance requirement (Toughest) dB | Round Metal Frame (The worst case) |
| Low Band (824-960MHz) | <3 | 2.6 |
| High Band (1710-2170MHz) | <3 | 2.5 |

Antenna 1 (S11) - Primary Antenna
Antenna 2 (S22) - Sub Antenna

MULTI-BAND FRAME ANTENNA

CROSS-REFERENCE TO RELATED PATENT APPLICATION

The present application claims the benefit of the earlier filing date of U.S. provisional application 61/695,198 having common inventorship with the present application and filed in the U.S. Patent and Trademark Office on Aug. 30, 2012, the entire contents of which being incorporated herein by reference.

BACKGROUND

1. Field of Disclosure

This disclosure relates to a multi-band frame antenna, and more specifically, to a multi-band frame antenna to be used for multiple-input multiple-output (MIMO), Global System for Mobile Communications (GSM), General Packet Radio Service (GPRS), Enhanced Data-rates for Global Evolution (EDGE), Long Term Evolution (LTE) Time-Division Duplex (TDD), LTE Frequency-Division Duplex (FDD), Universal Mobile Telecommunications System (UMTS), High-Speed Packet Access (HSPA), HSPA+, Code Division Multiple Access (CDMA), Wideband CDMA (WCDMA), Time Division Synchronous Code Division Multiple Access (TD-SCDMA), or future frequency bands.

2. Description of the Related Art

The "background" description provided herein is for the purpose of generally presenting the context of the disclosure. Work of the presently named inventor, to the extent it is described in this background section, as well as aspects of the description which may not otherwise qualify as prior art at the time of filing, are neither expressly nor impliedly admitted as prior art against the present invention.

As recognized by the present inventor, there is a need for a wideband antenna design with good antenna efficiency to cover Long Term Evolution (LTE), multiple-input/multiple-output (MIMO), and many other new frequency bands scheduled around the world. In a conventional wideband antenna, a plurality of ports (feeding points) of the antenna system usually correspond to a corresponding number of antenna components or elements. In a conventional two Port MIMO LTE antenna arrangement, top and bottom antennas may be a main and a sub/diversity antenna, respectively, or vice versa. The antennas are discrete antennas, optimized for performance in the frequency bands in which they were designed to operate.

The conventional wideband antenna designs do not generally meet the strict requirements in hand-head user mode (a carrier/customer specified requirement) and in real human hand mode (reality usage). These requirements have become critical, and in fact, have become the standard radiated antenna requirement set by various carriers (telecommunication companies) around the world. Hence, there is a need for a wideband antenna design with good antenna efficiency, good total radiated power (TRP), good total isotropic sensitivity (TIS) (especially in user mode, that is head-hand position), good antenna correlation, balanced antenna efficiency for MIMO system, and at the same time, good industrial metallic design with strong mechanical performance.

To make mobile devices look metallic, non-conductive vacuum metallization (NCVM) or artificial metal surface technology is conventionally used and widely implemented in the mobile device industry. A mobile device housing with a plastic frame painted with NCVM is very prone and vulnerable to color fading, cracks, and scratches.

The NCVM can cause serious antenna performance degradation if the NCVM process is not implemented properly, which has happened in many cases due to difficulties in NCVM machinery control, manufacturing process imperfections, and mishandling. Also, the appearance of NCVM does not give a metallic feeling, and looks cheap.

In order to effectively hold the display assembly of a mobile device, the narrow border of the display assembly requires a strong mechanical structure such as a ring metal frame. Conventional antennas for smartphones and other portable devices do not generally react well in the presence of a continuous ring of surrounding metal, as the metal negatively affects the performance of these antennas. Therefore, a continuous ring of metal around a periphery of a device is generally discouraged as it is believed to distort the propagation characteristics of the antenna and distort antenna patterns.

In one conventional device, a discontinuous series of metal strips are disposed around the electronic device to form different antenna segments. The strips are separated by a series of 4 slots, so that there is not a continuous current path around the periphery of the device. Each segment uses its own dedicated feed point (antenna feed, which is the delivery point between transmit/receive electronics and the antenna). This design uses multiple localized antennas with corresponding feed points. Each segment serves as one antenna, and requires at least one slot or two slots on the segment. Each segment acts as a capacitive-fed plate antenna, a loop antenna, or a monopole antenna. The difference between this design and a flexfilm/printing/stamping sheet metal antenna is that these antenna segments surround the outer area of the mobile device, while the flexfilm/printing/stamping sheet metal antenna is inside the device and invisible to the user.

As recognized by the present inventor, a problem with the antenna segments that surround the electronic device is that when a human's hands are placed on the smartphone, the human tissue serves as a circuit component that bridges the gap between segments and detunes the antenna, thus degrading performance. Moreover, these devices are sensitive to human contact due to the several slots being in direct contact with the human hand during the browsing and voice mode and creating a hotspot being around the affected slot.

SUMMARY

This disclosure describes a multi-band frame antenna that can be used for LTE, MIMO, and other systems that use different frequency bands. The frame antenna includes two main parts: a metallic frame with no gaps or discontinuities, and a block. The outer perimeter of the metallic frame surrounds the outer perimeter of the block, and there is a gap between the metallic frame and the block. A number of antenna feeds are routed across the gap, between the metallic frame and the block. A number of electrically shorted connections may also be made across the gap, between the metallic frame and the block.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
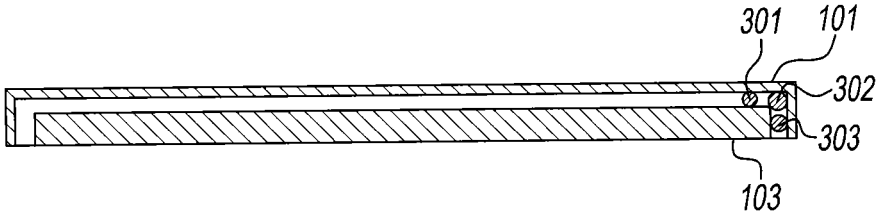
FIG. 1 is a cross-sectional view of a first embodiment of a frame antenna according to the present disclosure.

Referring now to the drawings, wherein like reference numerals designate identical or corresponding parts throughout the several views, FIG. 1 is a cross-sectional view of a frame antenna according to the present embodiment. A metallic frame 101 is an annular structure that is free of complete electrical discontinuities, slits, slots or other partitions that would prohibit an electric current from traversing an entire perimeter of the metallic frame 101. The term "continuous" means that there is a continuous conductive path, even though holes or other non-conductive areas may be present in the frame. For example, the metallic frame 101 may have holes bored therethrough for providing access to an internal part of the device. The frame 101 receives a block 103 therein as will be discussed in more detail below, so that the frame 101 surrounds a periphery of the block 103.

Between the frame 101 and block 103 are different candidate feed points 301, 302, and 303. Feed points 301, 302, and 303 are disposed in a gap between the metallic frame 101 and the block 103, and the outer perimeter of the metallic frame 101 surrounds the outer perimeter of the block 103. A vertical feed point 301 is shown with two alternatives, a horizontal feed point 303 and a tilted orientation (hybrid) feed point 302 which is placed on an inner corner and is thus half-horizontal and half-vertical. Feed points may be placed anywhere across the gap between the metallic frame 101 and 103 with the particular locations affecting the performance as will be discussed in subsequent figures.

The block 103 contains a set of materials that are laminated together as will be discussed with respect to FIGS. 3A and 3B. The components of the block 103 include the electronics and structural components of a smartphone, for example, which provides wireless communication with a remote source. While the term "block" is used, it should be understood that the block may a plate or other object having a two-dimensional surface on which the circuit components may be mounted.

The gap between the metallic frame 101 and the block 103 is 0.5 mm in this embodiment. However, the gap may be larger or smaller in some areas (typically between 0.2 and 0.9 mm), resulting in non-regular gap distance. The larger the gap, the better the antenna performance. However, the a larger antenna may not be easily accommodated in a small smartphone or other electronic device that requires the use of an antenna. A variety of non-conductive loading (dielectric) materials may be used to fill the gap, such as air, plastic, glass and so on.

Along the metallic frame 101, holes may be present to allow electronic interface connectors such as USB, HDMI, buttons, audio plugs, to pass therethrough. The metallic frame 101 is shown as a conductive rectangular-shaped path but may also be of a non-rectangular shape, such as circular or a rounded shape, so as to accommodate a periphery of the electronic device on which it is used. The shape may have rounded corners or tapered corners or any other shape as long as it is a conductively continuous metal frame. The block 103, too, may have a non-rectangular shape, although a periphery of the block 103 should generally follow that of the metallic frame 101 so as to not have too large of a gap between the two. Moreover, the outer perimeter of the metallic frame 101 generally surrounds a periphery of the block 103.

Figure 2:
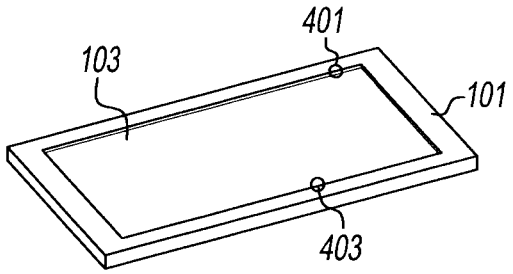
FIG. 2 is a perspective view of the frame antenna with two feed points.

FIG. 2 is a perspective view of a frame antenna with two feeds on the metallic frame 101 to support operation in two different frequency bands. A main antenna feed 401 may is used for the main antenna (cellular communications), and a sub/diversity antenna feed 403 may be used for a sub, or diversity antenna and vice versa. Antenna feed locations, as will be discussed, are set to excite the antenna resonances for the selected transmit and receive frequencies. There may be ground connections in these configurations (between the metallic frame 101 and the block 103) as will be discussed. The main feed 401, in this example is placed on one of the long edges of the metallic frame 101, and the sub/diversity antenna feed 403 is placed on the other long edge of the metallic frame 101. Various performances as a function of feed-point locations will be discussed in reference to subsequent figures. In this example of a rectangular shape frame, the longer side is between 100 mm and 140 mm and the shorter side is between 60 mm and 80 mm. In particular the example frame shown in FIG. 1 has dimensions of 124 mm×70 mm×8 mm.

Figure 3A:
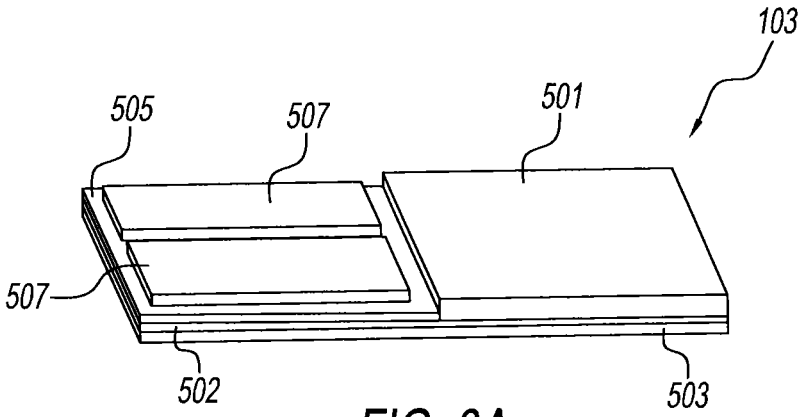
FIG. 3A is a perspective view of a block having various components that is disposed within a periphery of the frame antenna.
Figure 3B:
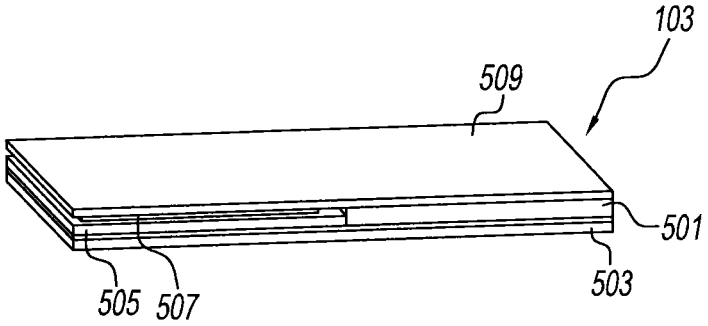
FIG. 3B shows the same block as FIG. 3A, but with a cover placed on a back of the block.

FIG. 3A shows the block 103 without a cover, and FIG. 3B shows the block 103 with a plastic cover 509. In FIG. 3A, the basic mobile device assembly is shown without the metallic frame 101. FIG. 3A shows an arrangement of the block 103 having a display assembly 503, a printed circuit board (PCB) 505, shield cans 507 that shield electronic components, and a battery 501. The PCB 505, the shield cans 507, and the battery 501 are stacked on the block 103 and their assembly on the block 103 is flexible as long as all these components are electrically connected and the PCB 505 system ground is connected to the block 103. The display signal bus and its ground may be electrically connected to the PCB 505 via flexfilm, cable, or alike. The PCB 505 may optionally be L-shaped. FIG. 3B shows a metal or plastic back cover 509 that covers the PCB 505, the shield cans 507, and the battery 501. The gap between the metallic frame 101 and the rest of the assembly is filled with non-conductive material.

Figure 4:
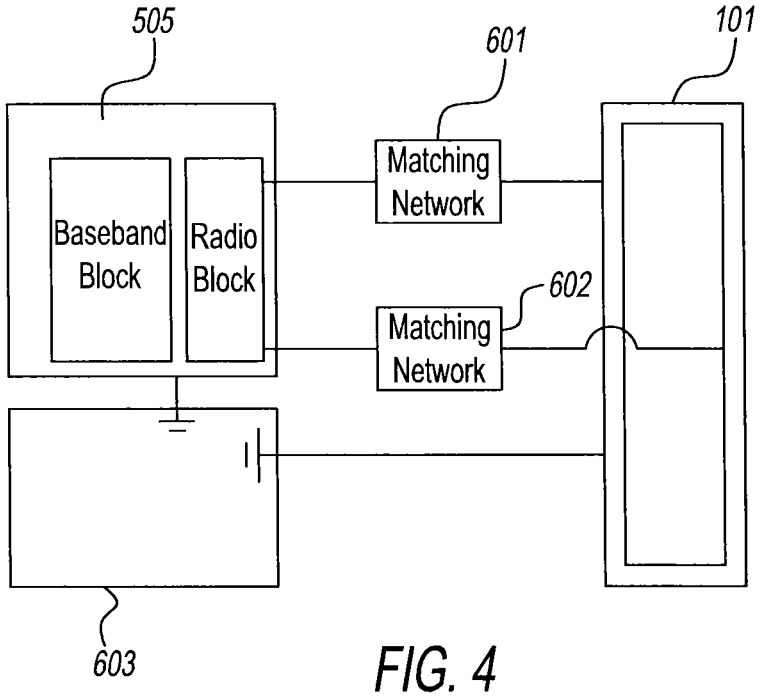
FIG. 4 is a block diagram of an exemplary arrangement of a block, circuit board, and frame structure, including matching network and feed points.

FIG. 4 is a block diagram schematic showing how the metallic frame 101 interconnects with a metal plate 603 with a PCB 505. The metal plate 603 may be disposed over or under the PCB 505. The PCB 505 includes a base band processing block that has circuit components for performing base band processing. The PCB 505 also hosts a radio block that includes RF circuit components with an interface that connects to the metallic frame 101 at feed points through matching networks 601 and 602. Matching networks 601 and 602 performs impedance matching between the radio block and the metallic frame 101.

Figure 5A:
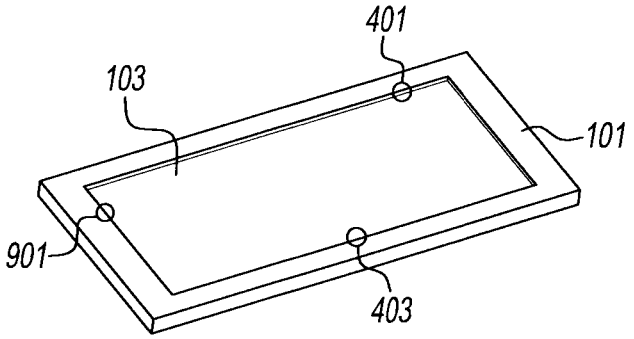
FIGS. 5A and 5B are perspective views of two different configurations of a frame antenna with a main antenna feed, a sub-antenna feed, and a non-cellular antenna feed.
Figure 5B:
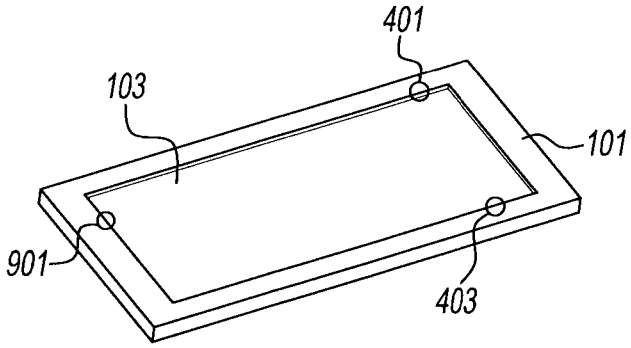

FIGS. 5A and 5B are perspective views of two different configurations of a frame antenna with three feeds. A main antenna feed 401 covers the frequency bands of a main antenna. A sub/diversity antenna feed 403 covers the sub-antenna or diversity antenna frequency bands. A non-cellular antenna feed 901 covers non-cellular bands such as Bluetooth, GPS, Glonass, and WLAN 2.4/5.2a,b,c. Ground connections between the metallic frame 101 and the block 103 are included.

There are many other possibilities for feed combination. For example, a two feed configuration may be realized where both feeds are metallic frame feeds, one feed is used for the main antenna and GPS, while the other feed is used for the sub antenna, Bluetooth, and WLAN 2.4/5 GHz. In another two feed configuration, one feed is a metallic frame feed used for the main antenna, while the other feed is a metallic frame or a flexfilm feed, and is used for sub antenna, Bluetooth, WLAN 2.4/5 GHz, and GPS.

For a mobile phone that does not require a sub antenna, a single feed may be used for both the main and the non-cellular antenna, or two feeds may be used, one for the main antenna and one for the non-cellular antenna. If a single feed is used, the PCB 505 includes a diplexer to direct the electrical signals of the appropriate frequency band to and from the metallic frame 101.

The combination of a main antenna and a sub antenna that covers all frequency bands (including LTE or future bands) may create a MIMO antenna system.

FIG. 5B is similar to FIG. 5A except for the sub-diversity antenna feed 403 as positioning closer to the short side of the metallic frame 101.

Figure 6:
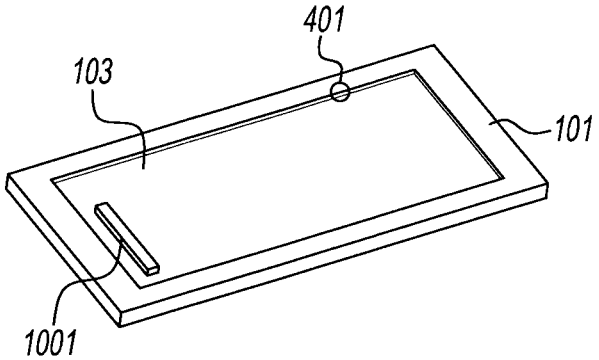
FIG. 6 is a perspective view of the frame antenna combined with a flex film/printing/stamping antenna.

FIG. 6 shows another embodiment of the metallic frame 101 that includes a main antenna feed 401 in addition to a flex film/printing/stamping antenna 1001. The flex film/printing/ stamping antenna 101 provides a sub-feed antenna that has a dedicated antenna element used as a radiation surface.

Figure 7A:
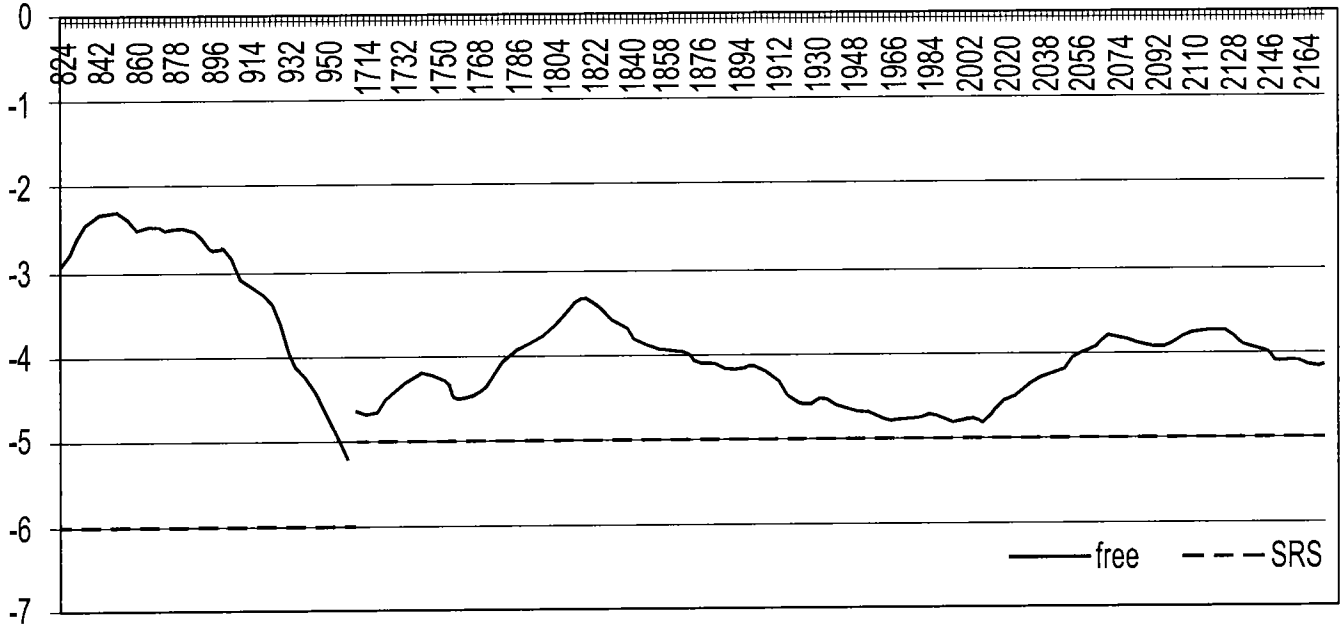
FIGS. 7A and 7B show antenna efficiency and free space and head-hand mode characteristics respectively for the frame antenna of the present embodiment.
Figure 7B:
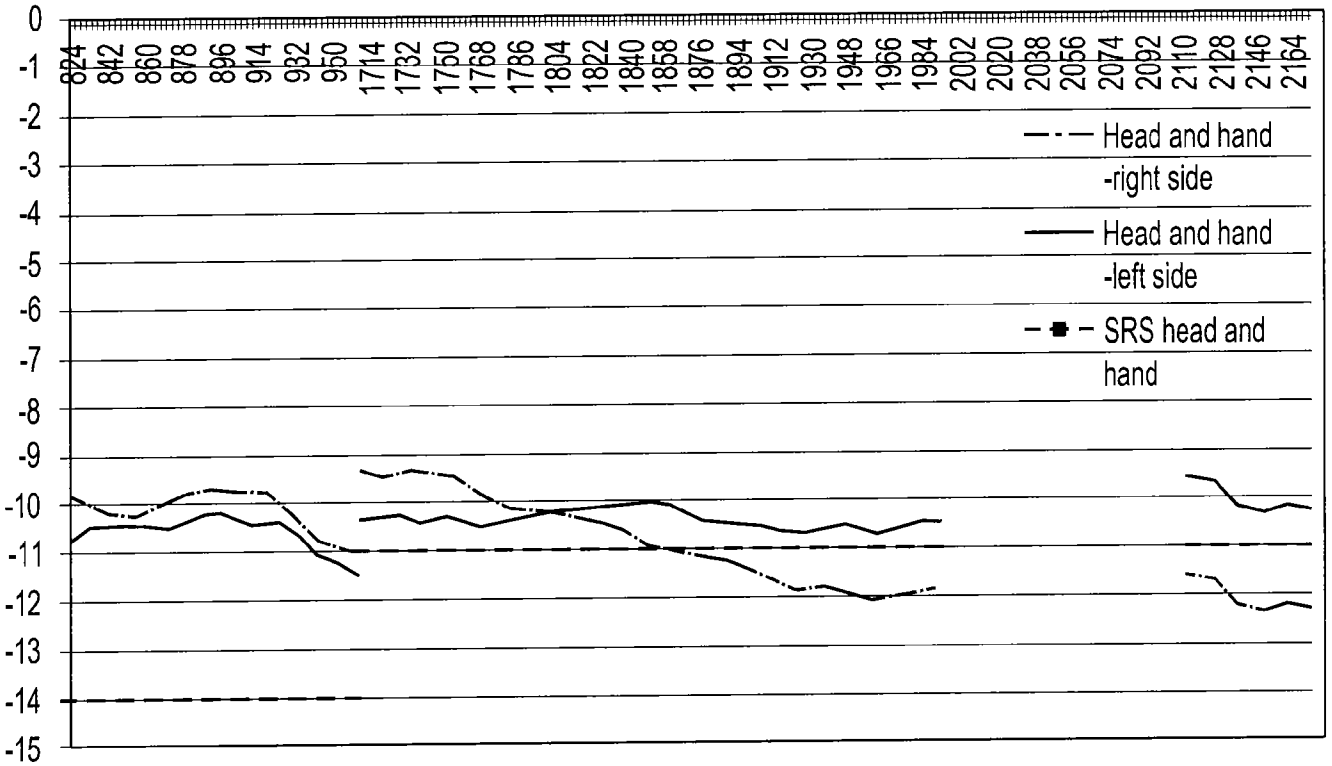

FIG. 7A is an antenna efficiency graph of the frame antenna shown in FIGS. 5A, 5B, and 6 in free space as a function of frequency relative to a standard when using the main antenna feed. FIG. 7B is similar, although shows the metallic frame 101 is included in a handset held at a right side of a body and left side of a body. The graph is a function of frequency and demonstrates an amount of radiation efficiency relative to a peak and compared to a standard radiation efficiency when operating next to a head and held in a hand.

Figure 8:
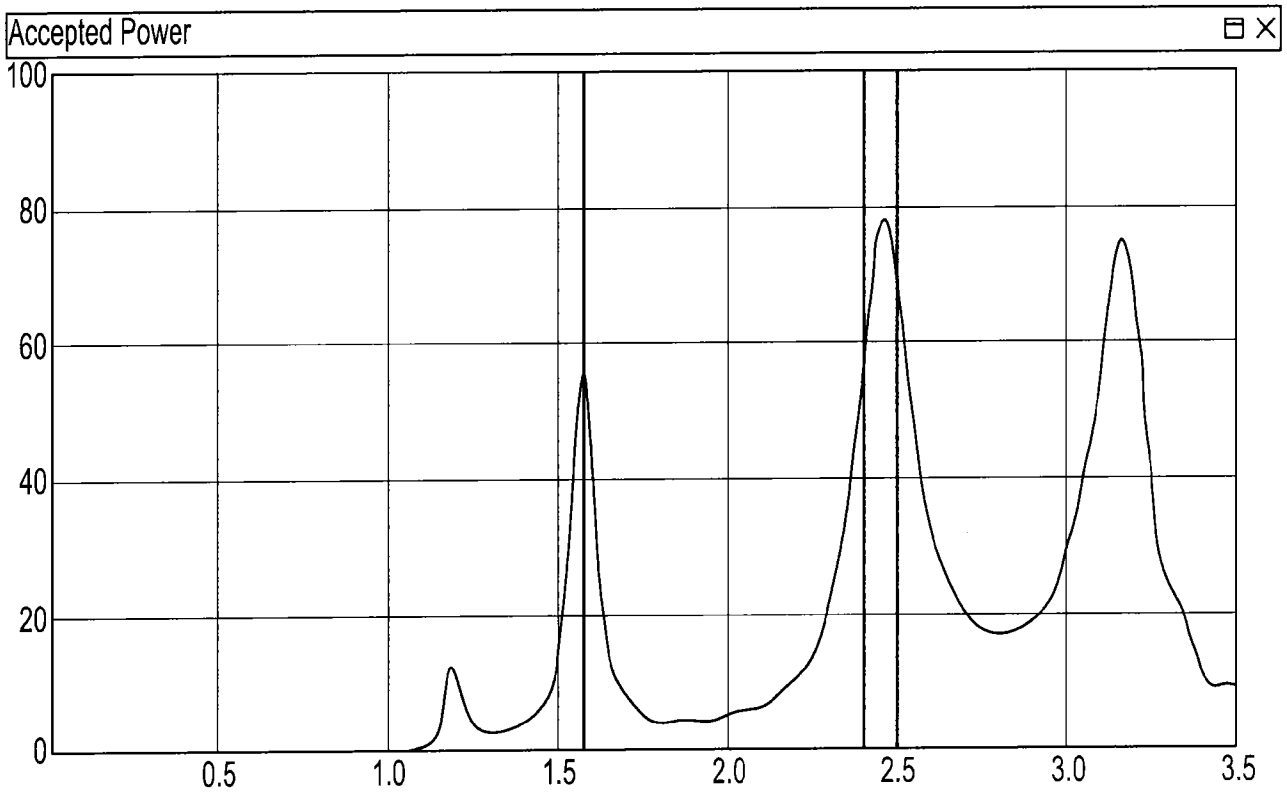
FIG. 8 is a chart of radiation efficiency of a non-cellular antenna performance for the frame antenna of the present embodiment.

FIG. 8 is a graph of accepted power vs. frequency for the non-cellular antenna (feed 901 and 1001 in FIGS. 5A, 5B and 6) in free space. As seen in this figure, different frequency bands that support efficient communications are supported, such as at 1576 MHZ, 2400-2500 MHZ. Thus, the non-cellular antenna efficiency for feeds such as feeds 901 and 1001 of FIGS. 5A, 5B and FIG. 6 respectively demonstrate that the non-cellular antenna efficiency in free space provides acceptable performance.

Figure 9:
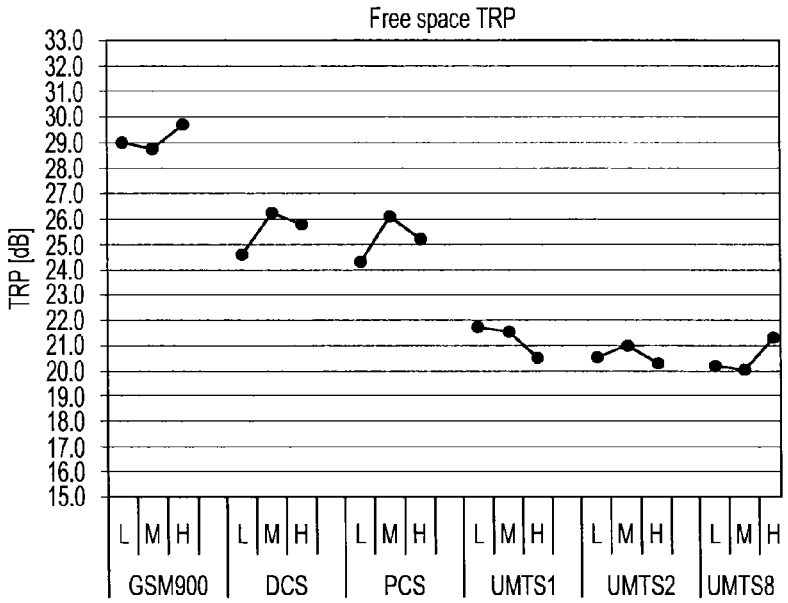
FIG. 9 is a table showing different wireless frequency bands verses total radiated power and free space for the frame antenna of the present embodiment.
Figure 10:
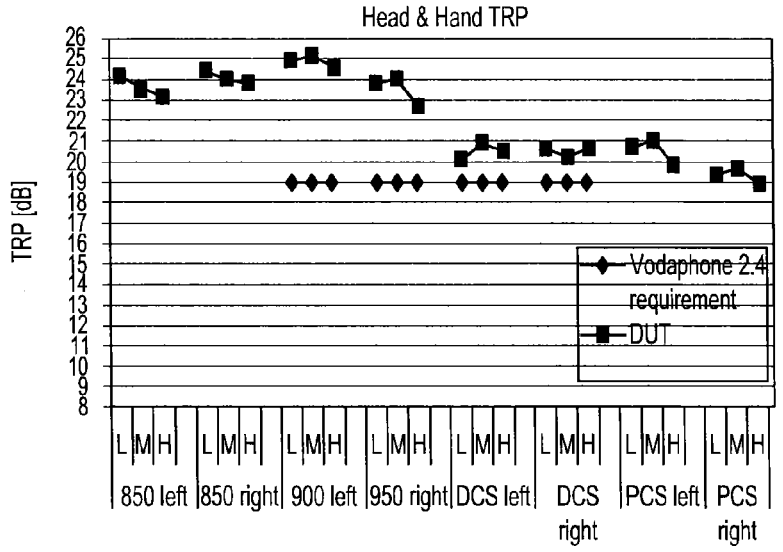
FIG. 10 is a similar chart to FIG. 9 but is of a head and hand total radiated power scenario relative to a standard performance.
Figures 11, 12:
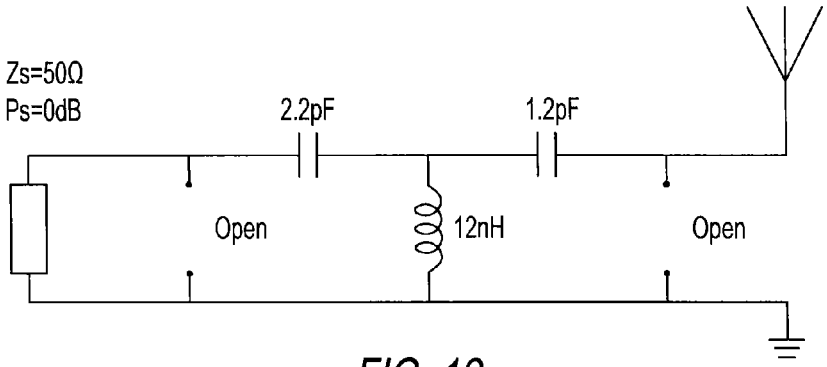
FIG. 11 is a table showing an antenna gain imbalance according to a frame antenna according to the present embodiment.
FIG. 12 is an exemplary matching network used to improve an S-parameter of the frame antenna of the present embodiment.

Likewise, FIG. 9 shows total radiated power (TRP) in free space for the antenna structure of FIGS. 5A, 5B and 6 for different frequency bands used in different communication systems. FIG. 10 is a similar radiated power verses frequency plot, although showing the performance of the antenna (FIGS. 5A, 5B and 6) relative to a vodafone 2.4 standard requirement or total radiated power. FIG. 11 shows a table of antenna gain imbalance, meaning that the antenna exhibits at least some gain imbalance relative to an isotropic radiation pattern, but not an undue amount of directionality. This is the case for both the low band, which in this example is 824-960 MHz, and high band (1710-2170 MHz). An exemplary radiation pattern for the metallic frame antenna includes a larger gain pattern in the upper hemisphere, which is desirable for satellite signal connection.

Lowering a voltage standing wave ratio (VSWR) provide better propagation performance and so in a strong handheld mode, the frequency resonances are even better matched, and no frequency shifting or detuning has occurs. Therefore, a switching device, an auto tuner, or an adaptive antenna with complexity is not needed for this antenna design, and good antenna performance is obtained. This also explains why the total radiated power (TRP) of this design is very good. Moreover, in existing devices where the sensitive zone (hotspot) is distributed around the localized metal ring and can be easily in touch with the user hand, the antenna performance is quite poor. The sensitive zone (hot spot) of this design is located around the inside of the gap/cavity. Thus, this design is strong against a user hand, and good handheld performance is obtained.

FIG. 12 shows an exemplary matching network with a metallic frame antenna 101 for a one feed embodiment with a chassis dimension of 124 mm×70 mm×8.8 mm. This matching network with RLC (resistor, inductor, capacitor) improves a low band (700 MHz-960 MHz) frequency performance by matching an input impedance of the RF output to the input impedance of the metallic frame 101 at the feed point. Exemplary RLC values are 50 ohm source that drives, 2.2 pF and 1.2 pF series capacitors with a parallel 12 nH inductor.

Figure 13:
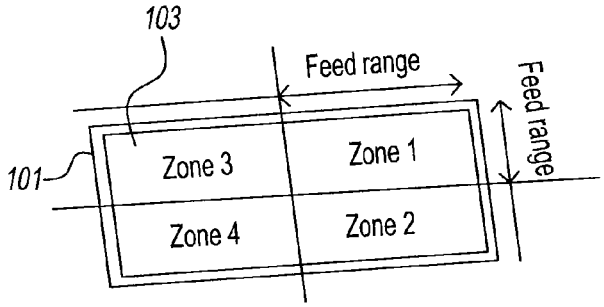
FIG. 13 is a schematic diagram of a footprint of an exemplary frame antenna, showing feed ranges for feed points in one of four different zones.
Figure 14:
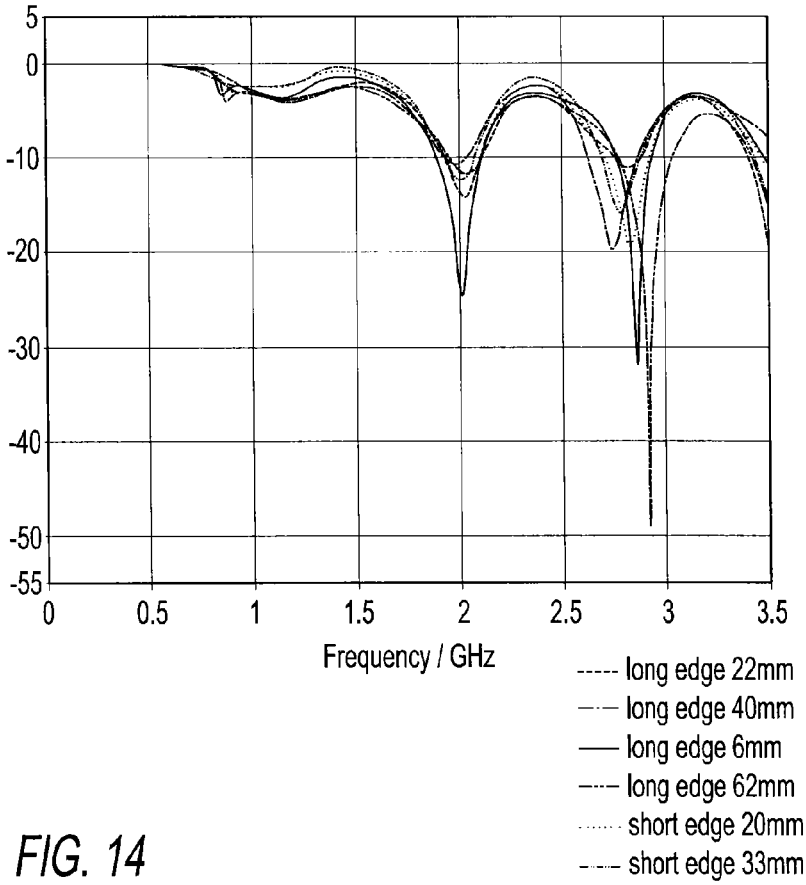
FIG. 14 is an S-parameter graph for the exemplary frame antenna, showing performance as a function of different feed points along a long edge and a short edge in reference to FIG. 13.

FIG. 13 shows a frame antenna divided into four zones to assist in describing the location of feed points within a range along the frame 101. Zone 1 has a "long edge" and a "short edge" and in subsequent examples feed point locations will be made in reference to an upper right hand corner of Zone 1. FIG. 14 is an S-parameter graph, which illustrates how much power is reflected from the antenna from a RF input. Thus, in a FIG. 14 it shows that for various feedpoints on the frame 101, the antenna radiates best between 2.7 and 2.9 GHz, but also radiates well around 2 GHz. In the specific example of FIG. 14, S parameter plots are provided for feed points on the long edge at 6 mm, 22 mm, 40 mm and 62 mm, as well as for feedpoints along the short edge at 20 mm and 33 mm.

Figure 15:
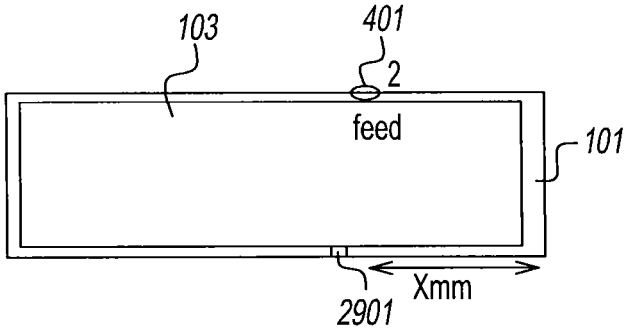
FIG. 15 is an exemplary frame antenna showing two example ground points.
Figure 16:
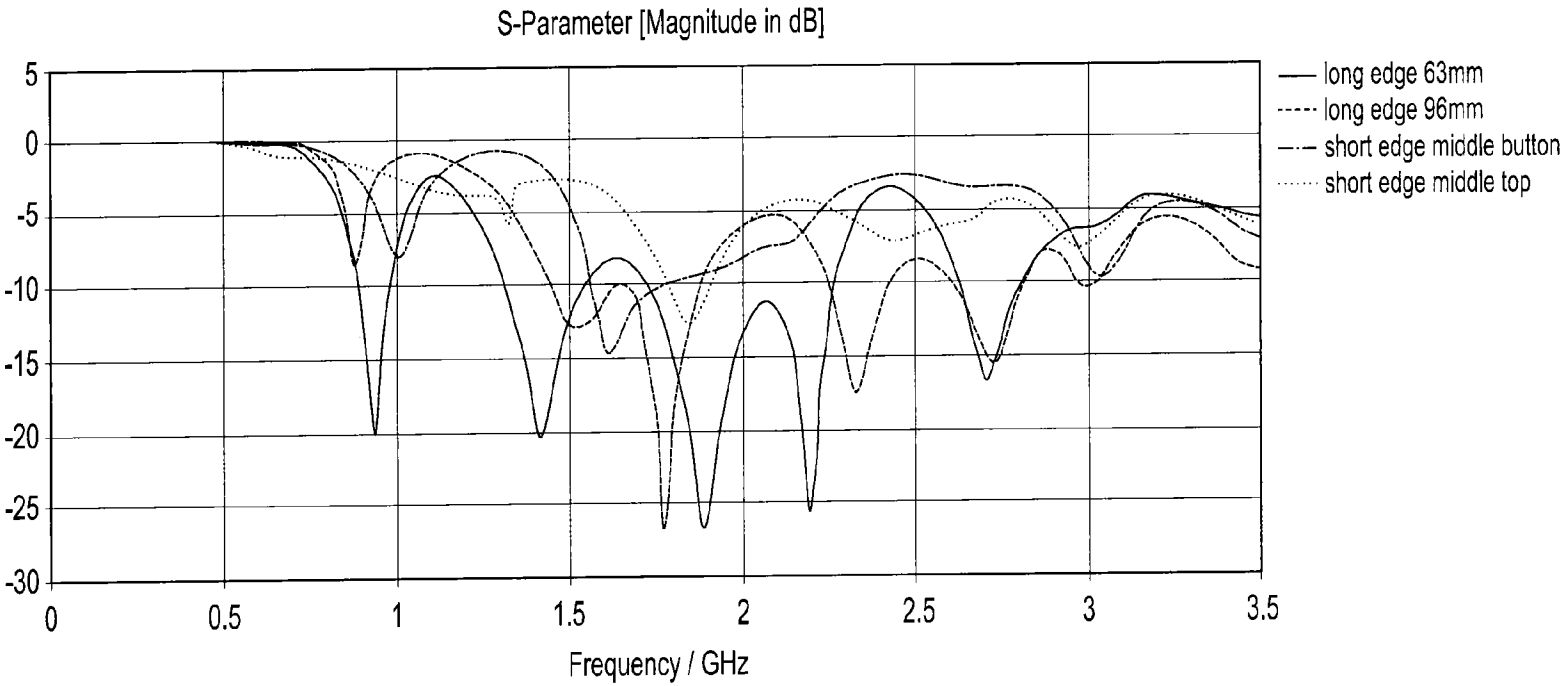
FIG. 16 is a S-parameter chart showing a performance as a function of frequency of different grounding points on the exemplary frame antenna.

FIG. 15 shows a frame antenna 401 with one feed 401, one grounding point 2901, and frame dimensions 124 mm×70 mm×8.8 mm. This antenna is used for a grounding point location analysis, and the analysis results are shown in the S-parameter plot of FIG. 16. FIG. 16 shows the S-parameters obtained among different grounding point locations at 63 mm along the long edge, 96 mm along the long edge, in the middle bottom (right hand side in FIG. 16) of the short edge, and in the middle top (left hand side in FIG. 16) of the short edge. The location of the grounding point 2901 may be used to assist in matching and tuning of this antenna configuration.

Figure 17:
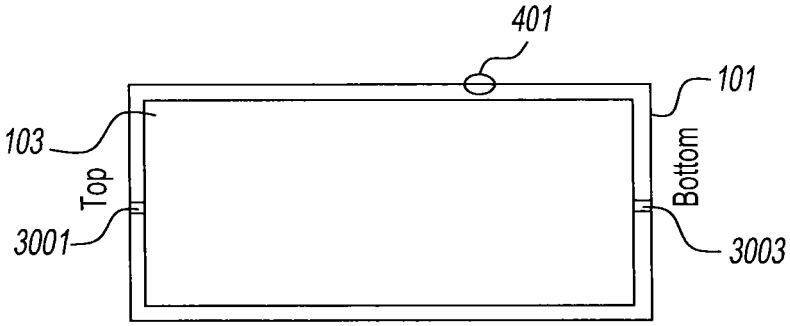
FIG. 17 shows an exemplary layout with different grounding points.
Figure 18:
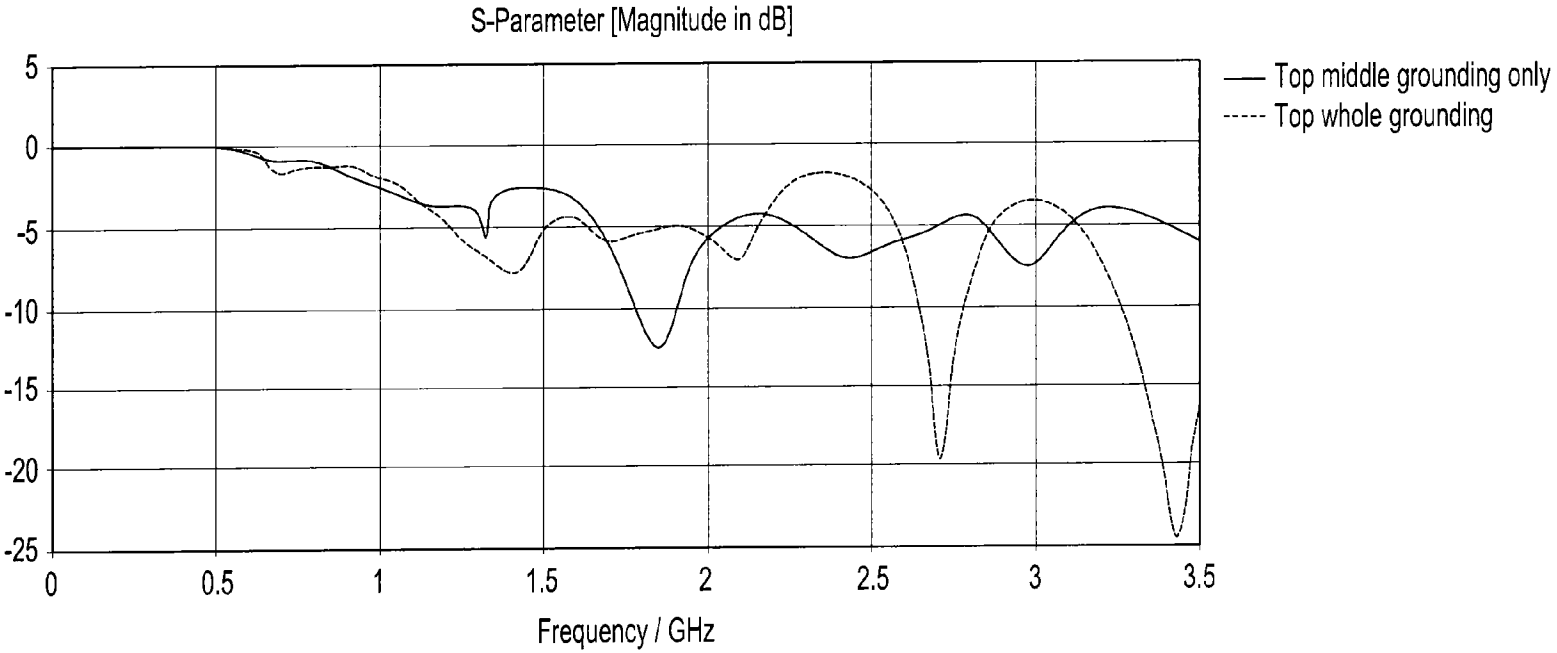
FIG. 18 is an S-parameter graph showing performance for different grounding locations.

FIG. 17 shows a frame antenna 101 used for a grounding location analysis, with one feed 401 and two grounding points on the top middle position 3001 and bottom middle position 3003. The grounding location may be chosen based on matching needs or the mechanical integration of the device under test (DUT). FIG. 18 shows the influence of the location and plurality grounding points on the S-parameter plot. "Top middle grounding only" refers to the case where the bottom grounding point is removed, and only the top grounding point remains. FIG. 18 also includes a plot where the whole top side 3101 of the frame antenna 101 is grounded. FIG. 18 thus shows the influence of the size of the grounding points on the S-parameter. Top middle grounding means a grounding point on the top with only 3 mm width.

Figure 19:
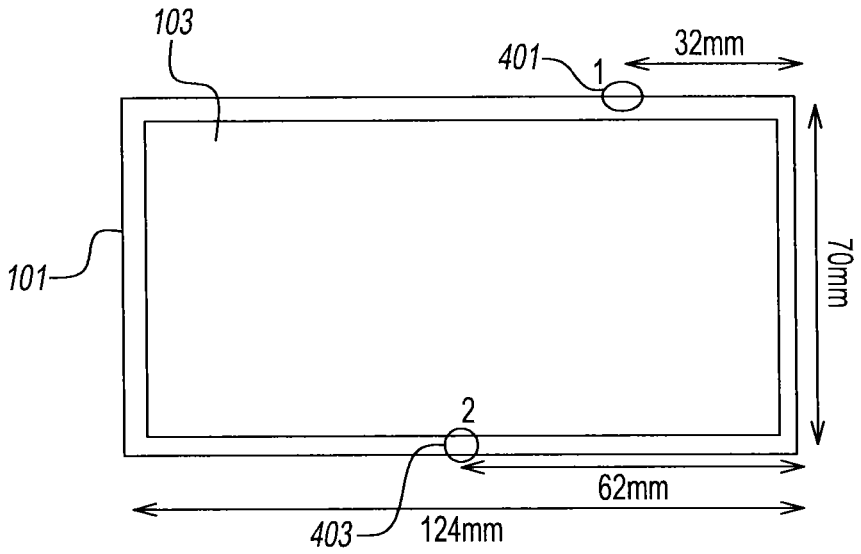
FIG. 19 shows an exemplary layout of two feed points on the exemplary frame antenna.

FIG. 19 shows a frame antenna 101 with two feeds, 401 and 403. Feed 401 is located 32 mm from the top right corner in FIG. 19, and feed 403 is located 62 mm from the bottom right corner. The antenna radiates well between 0.7 to 0.9 GHz, and 2.5 to 2.9 GHz.

Figure 20:
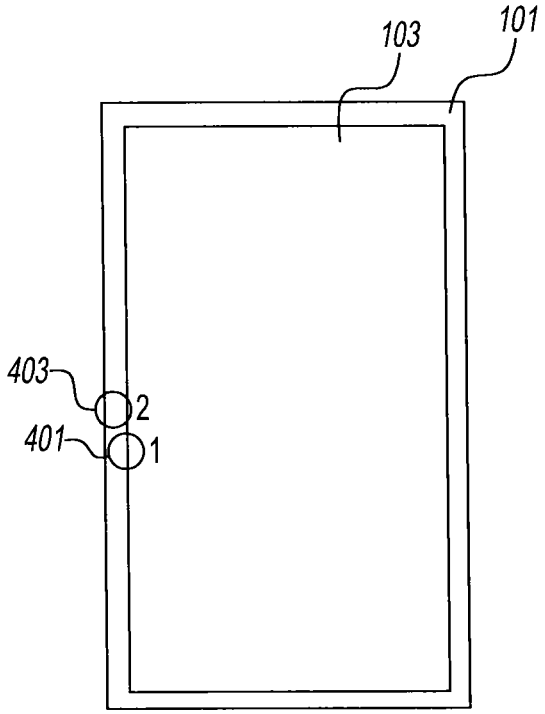
FIG. 20 is another exemplary embodiment, showing the effect of a distance between two feed points on a common side of the frame antenna.
Figure 21:
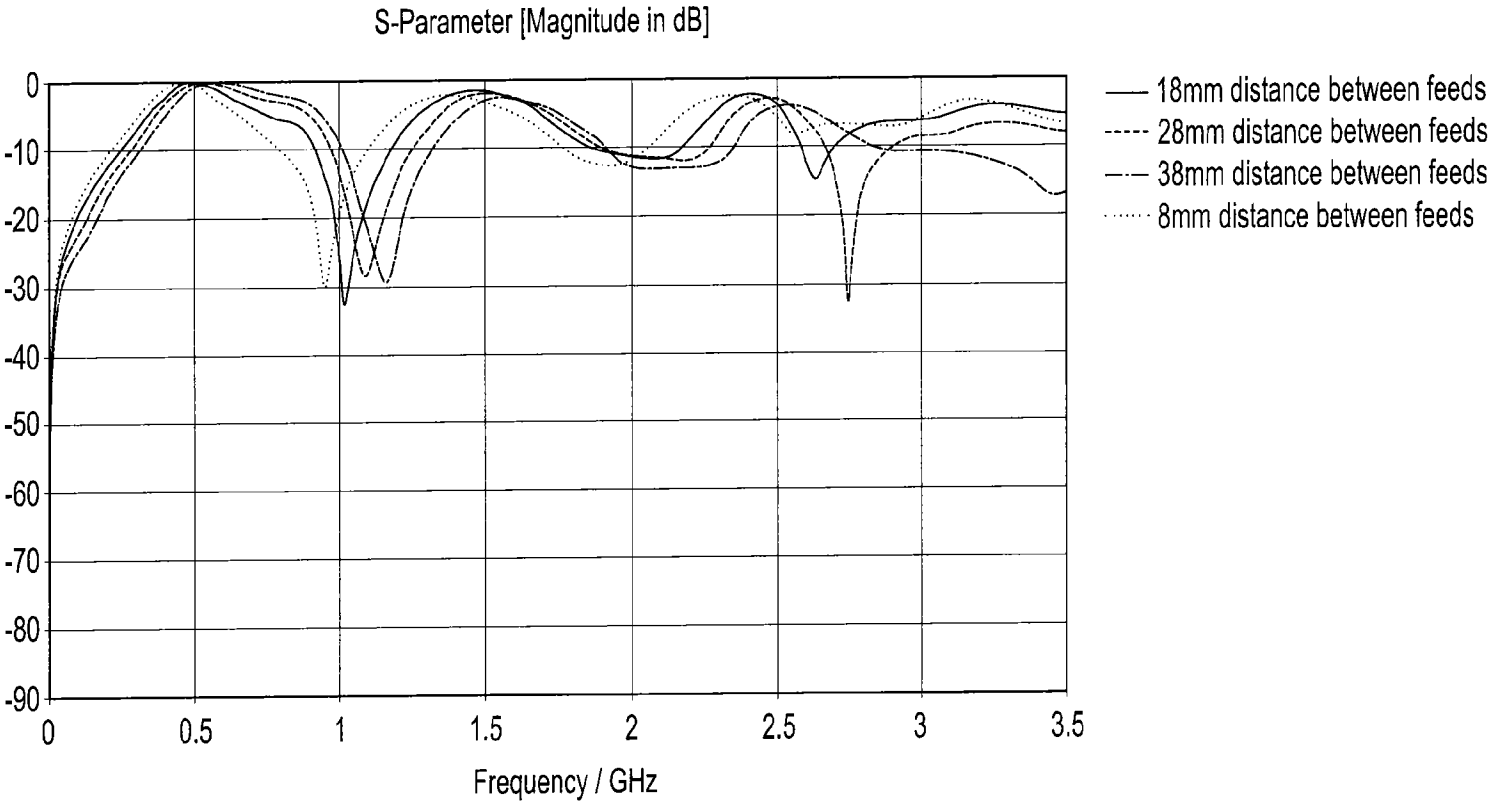
FIG. 21 is an S-parameter chart showing distances between antenna feeds and effect as a function of frequency.

FIG. 20 shows a frame antenna 101 with two feeds 401 and 403 that are located along a common long edge. A distance between the edge is changed and the corresponding S parameter plot for distances between the feeds of 8 mm, 18 mm, 28 mm and 33 mm are shown in FIG. 21. In this example the feed 403 is held fixed and the location of the feed 1 is changed progressively away from feed 403.

Figure 22:
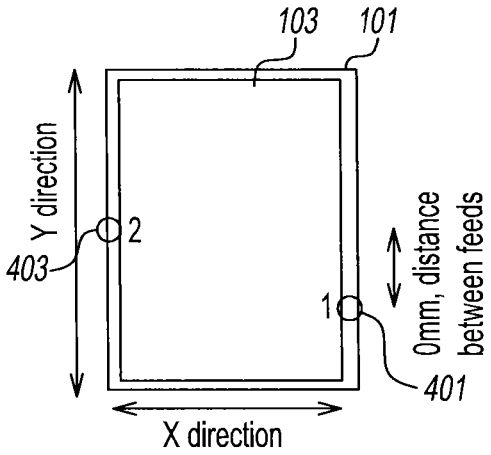
FIG. 22 is another exemplary layout showing different feed locations on opposite sides of the frame antenna of the present embodiment.
Figure 23:
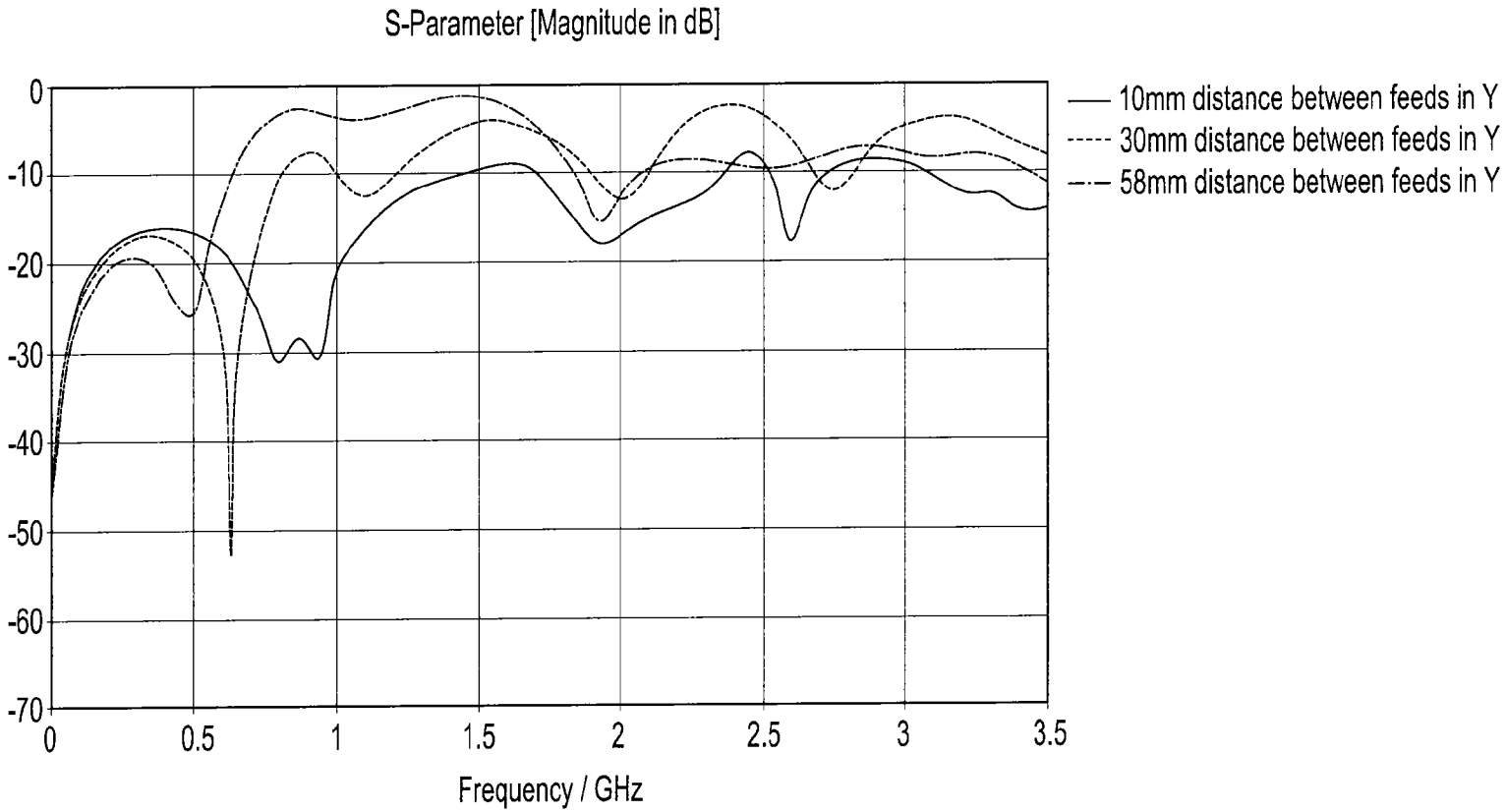
FIG. 23 is a S-parameter chart showing the distance between feeds on the long opposing sides of the frame antenna shown in FIG. 22.
Figure 24:
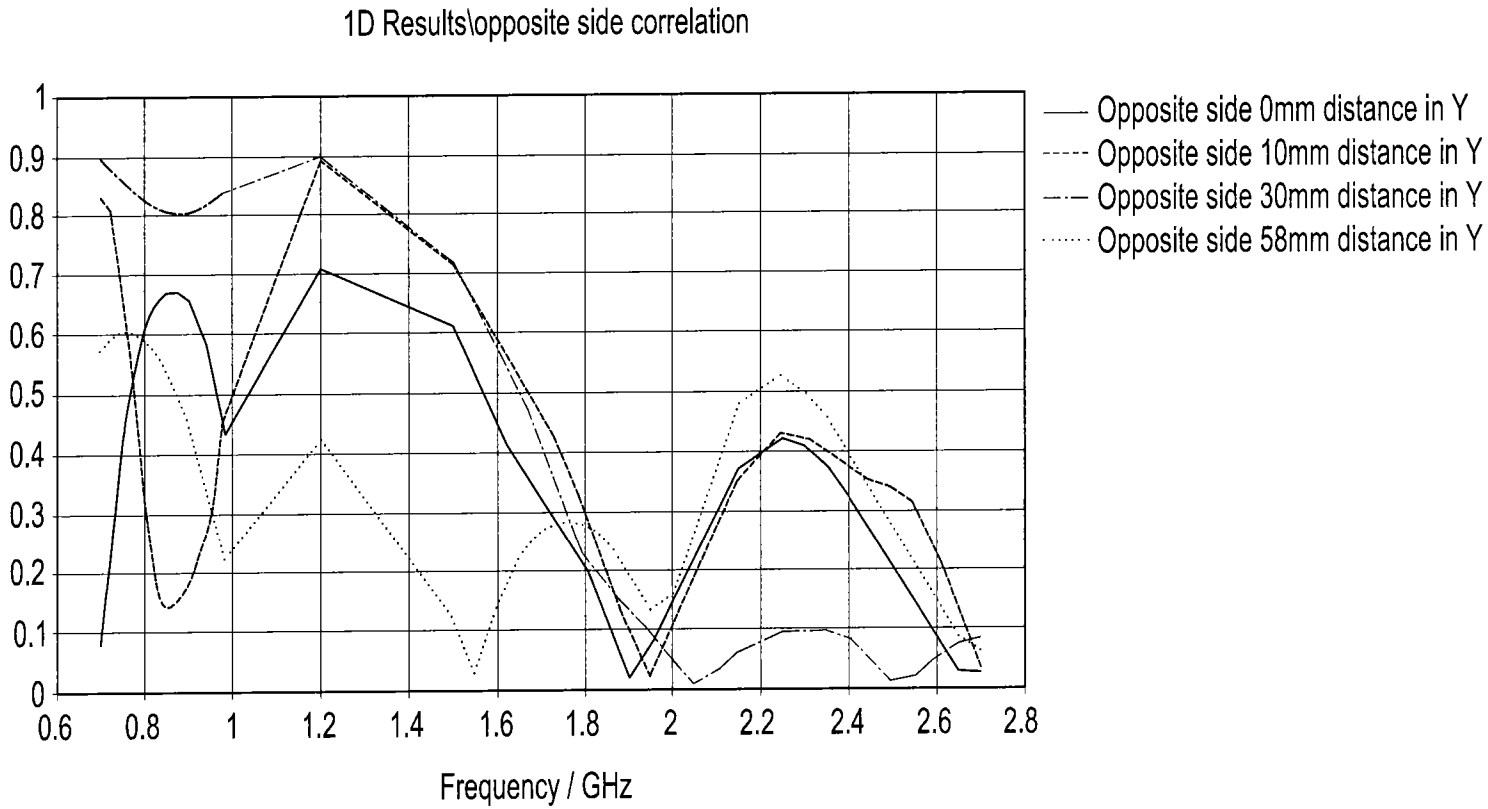
FIG. 24 is a correlation chart showing the effect on the opposite side feed point in a y direction for different feed positions.

FIG. 22 is similar to FIG. 20, although the first feed 401 is positioned on the other long edge of the frame 101. In particular, the first feed 401 is on a separate edge than the other feed 403. FIG. 23 then shows an S parameter plot for distances relative to a center point of 10 mm, 30 mm and 58 mm. FIG. 24 shows a correlation coefficient of the two feed metal frame 101 with different distances between the feeds. This figure shows that different locations and distances between the feeds result in different correlation coefficients as a function of frequency.

Figure 25:
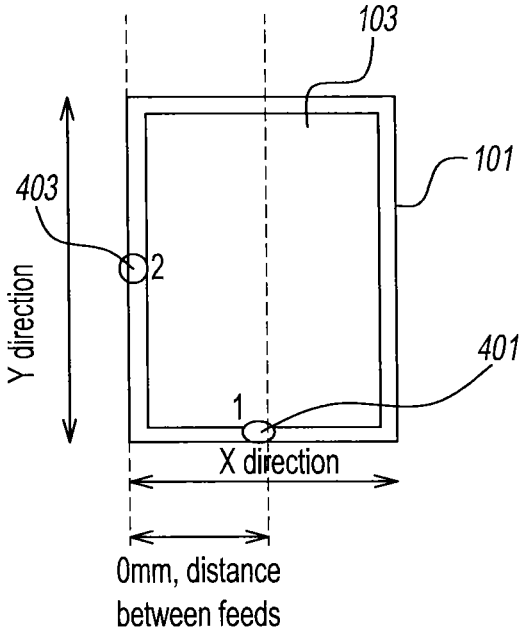
FIG. 25 is a third two-feed location antenna layout for the exemplary frame antenna.
Figure 26:
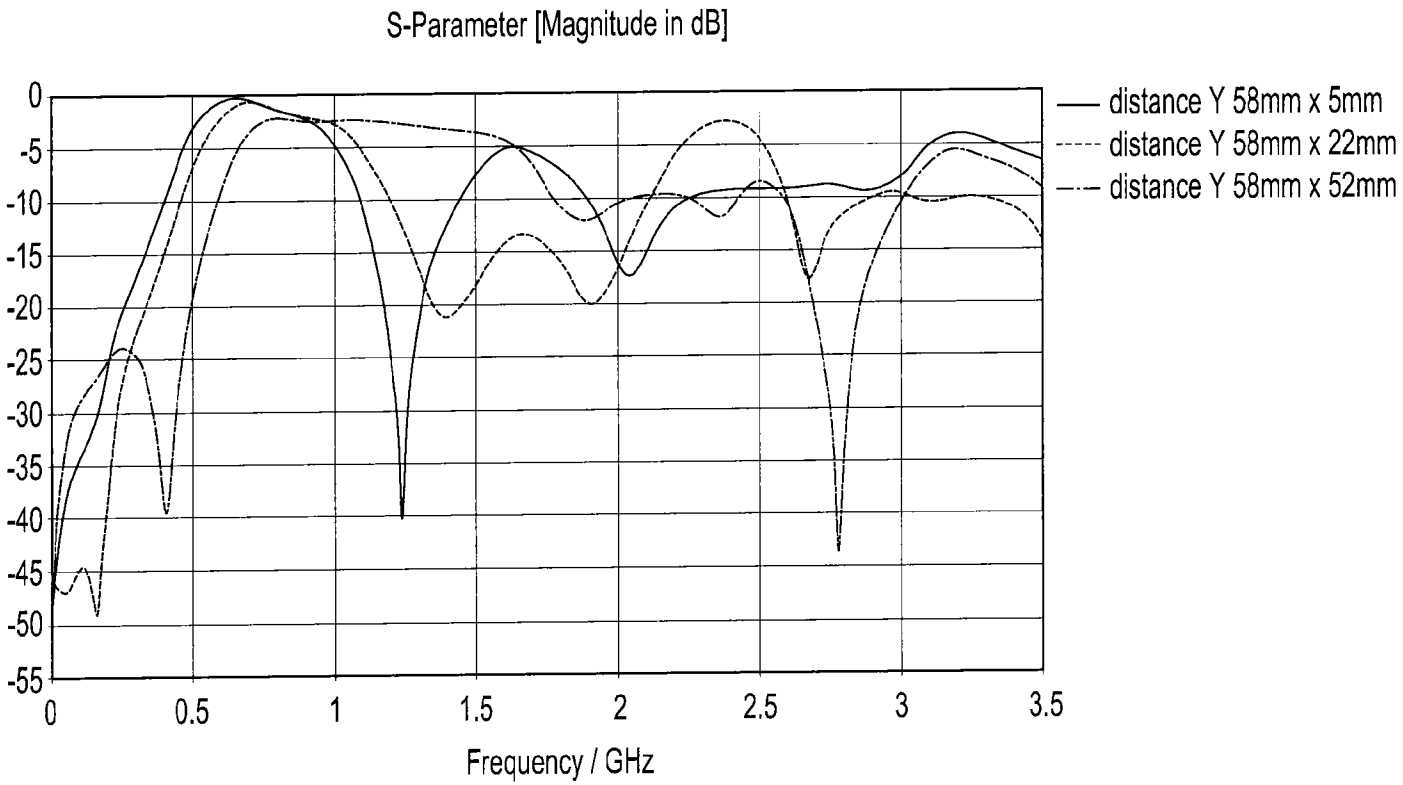
FIG. 26 is an exemplary S-parameter chart showing a performance at various feed point distances in a y direction.
Figure 27:
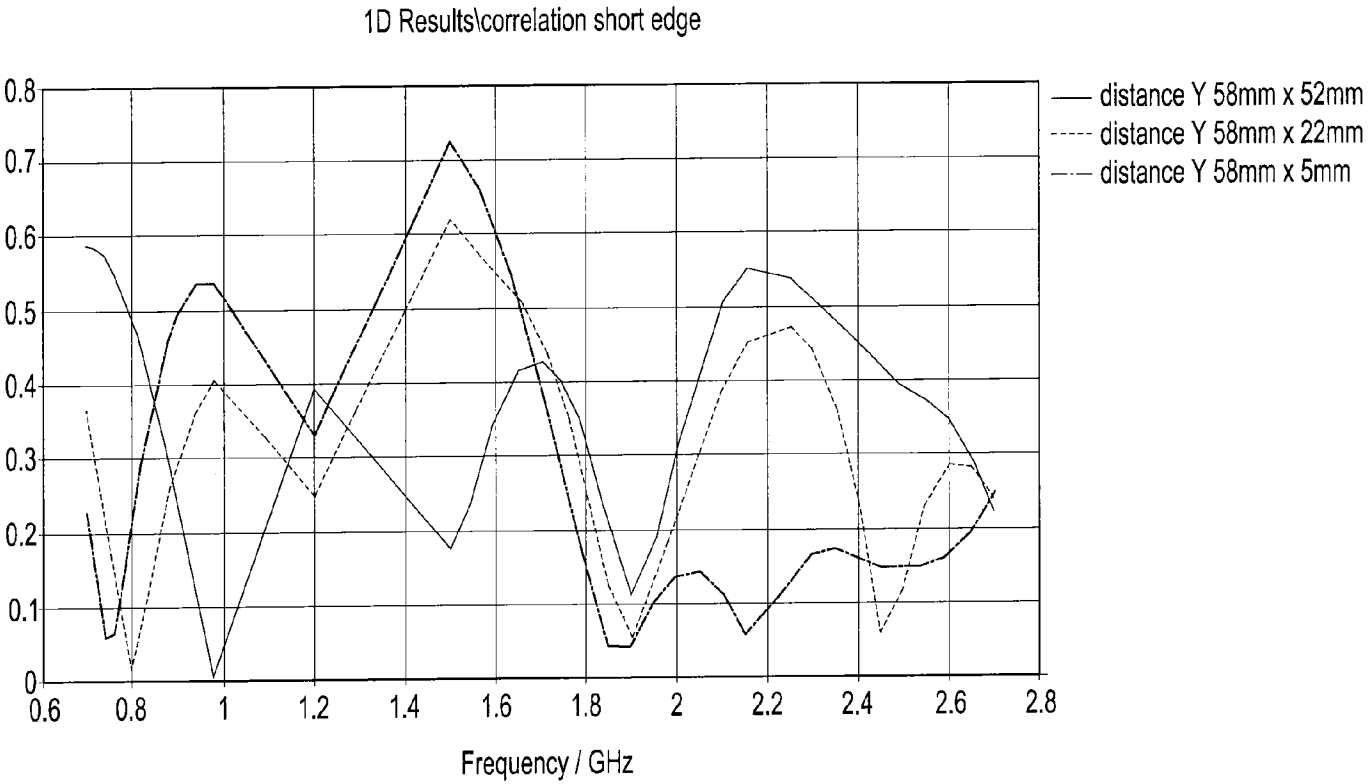
FIG. 27 is an exemplary correlation chart with a varied distance between two feeds in the x direction and the y direction.

FIG. 25 is another example embodiment showing the frame 101 with a first feed 401 on the short edge, and a fixed second feed 403 on the long edge. In FIGS. 26 and 27 an S parameter of the two feed metallic frame 101 antenna design shown in FIG. 25 is displayed with different distances between the feeds in the x direction. In this example, feed 403 is set at a fixed distance of 58 mm, but the feed 401 is varied between 5 mm, 25 mm and 52 mm. The plot of the S parameter is shown in FIG. 26 and the corresponding correlation coefficient of the two feed metallic frame antenna design with different distances between the feeds in the x direction is shown in FIG. 27.

Figure 28:
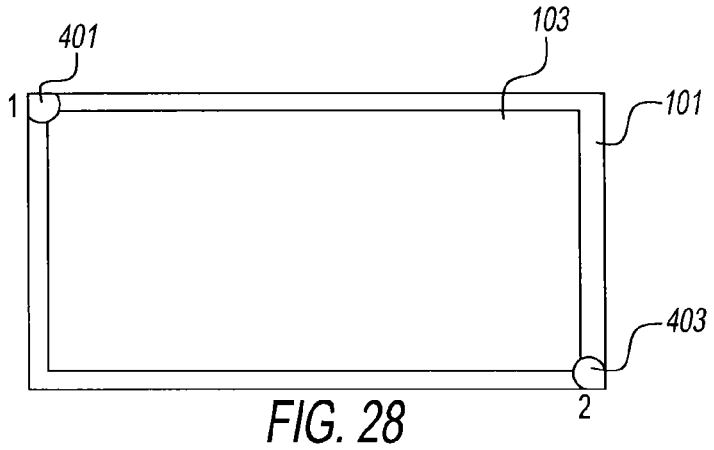
FIG. 28 shows another exemplary two-feed location for the exemplary frame antenna.
Figure 29:
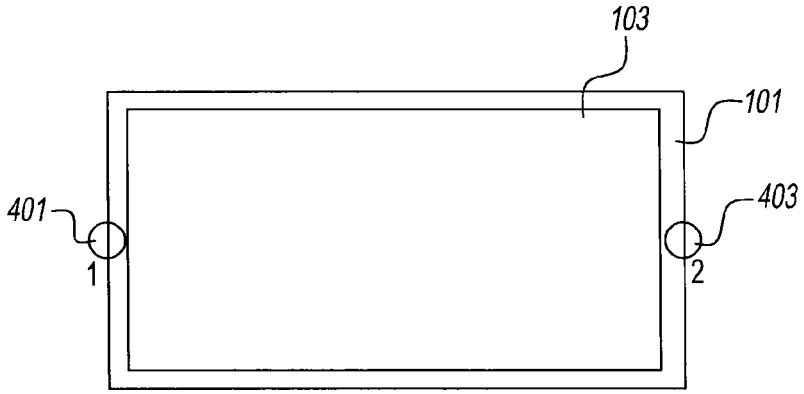
FIG. 29 is another exemplary pair of feed locations for the exemplary frame antenna.
Figure 30:
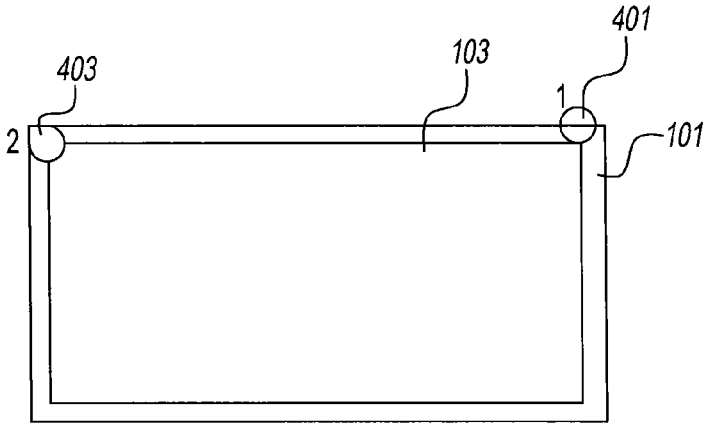
FIG. 30 shows another exemplary location for feed points of the exemplary frame antenna.

FIGS. 28, 29 and 30 show a similar frame antenna 101 with feeds 401 and 403 in opposite corners (FIG. 28), both feeds in top and middle positions (FIG. 29), and a frame antenna with two feeds on opposite corners of the same long edge (FIG. 30). Satisfactory performance is obtained with such configurations.

Figure 31:
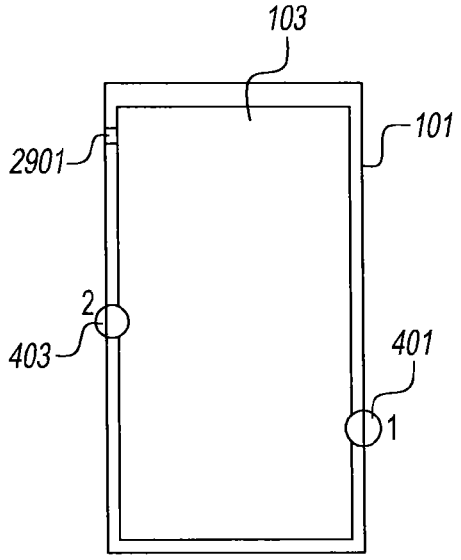
FIG. 31 is an exemplary grounding location layout for the exemplary frame antenna.
Figure 32:
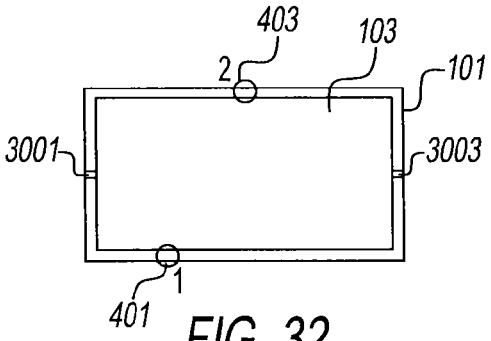
FIG. 32 is another exemplary layout for multiple ground points for the exemplary frame antenna.
Figure 33:
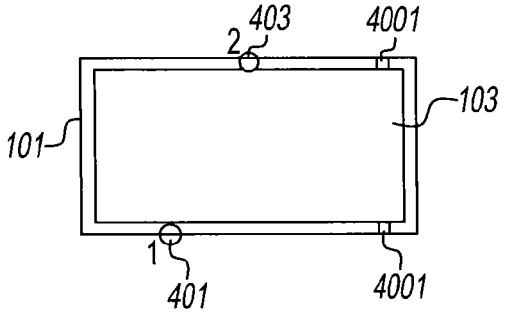
FIG. 33 is another example layout of ground points for the exemplary frame antenna.

The following figures show a variety of exemplary feed point and ground combinations. FIG. 31 shows a frame antenna 101 with two feeds and one grounding point 2901 with distance 47 mm in the Y direction from feed/port 2. FIGS. 32 and 33 show a frame antenna 101 with top middle ground 3001 and bottom middle ground 3003 along with dual feed positions as shown.

Likewise, FIG. 33 shows a frame antenna with two grounding points 4001 with a distance of 47 mm in a y direction from the feed port 2 (403) and a second ground at a further distance from the first feed point 401.

Figure 34:
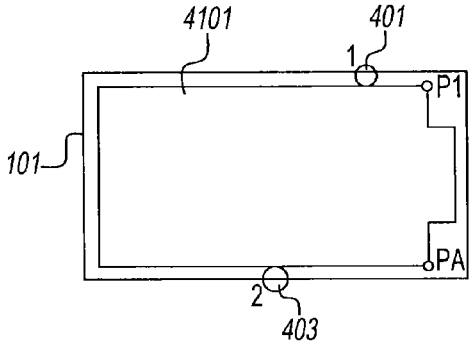
FIG. 34 shows a two feed ring metal antenna design which is the same as FIG. 32, but with different block/plate shape.

FIG. 34 shows a two feed ring metal antenna design which is the same as FIG. 32, but with different block/plate shape. In this case, the block/plate shape is a T shape 4101, thus it is referred to as 'T shape'.

Figure 35:
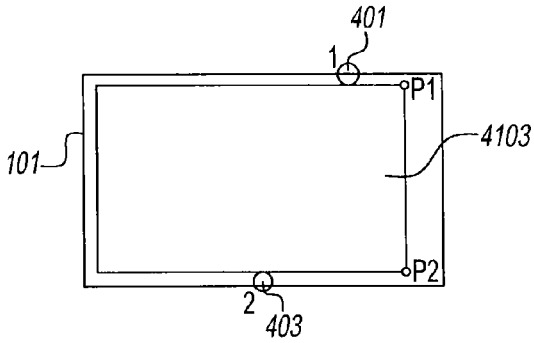
FIG. 35 shows a two feed frame antenna which is the same as FIG. 32, but with different distance between the frame and the block/plate.

FIG. 35 shows a two feed frame antenna 101 which is the same as FIG. 32, but with different distance between the frame 101 and the block/plate 103. In this case, the block/plate has a 12 mm gap distance 4103, thus it is referred to as '12 mm gap distance'.

Figure 36:
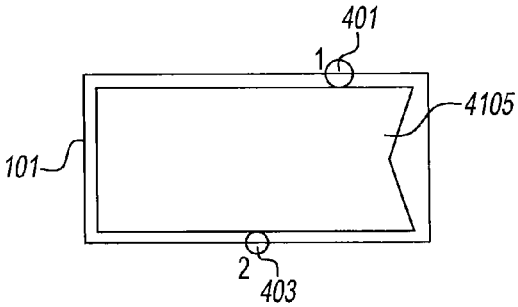
FIG. 36 shows a two feed frame antenna, with a block/plate shape that is a triangular shape.

FIG. 36 shows a two feed frame antenna 101, with a block/plate shape 4103 that is a triangular shape 4105, thus it is referred to as 'Triangle'.

Figure 37:
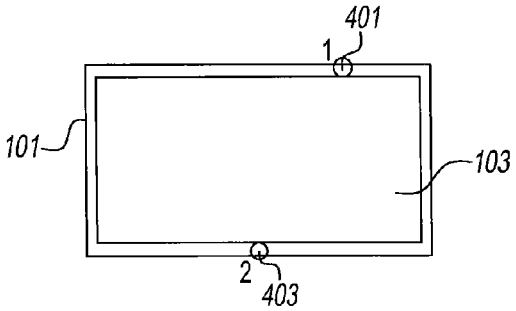
FIG. 37 shows a two feed frame antenna with a gap of about 3 mm.

FIG. 37 shows a two feed frame antenna 101 with a gap of about 3 mm 103, thus it is referred to as '3 mm rectangular'.

Figure 38:
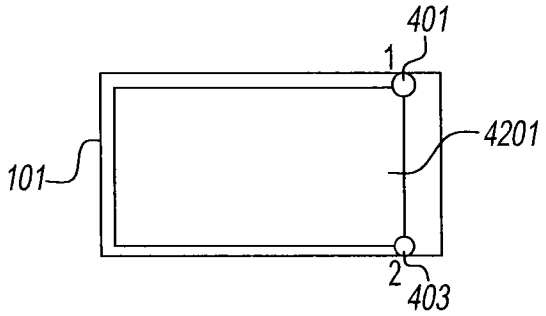
FIG. 38 shows a layout of an exemplary frame antenna with two parallel feeds and a rectangular gap sheet.

FIG. 38 shows a frame antenna 101 with 2 parallel feeds located at the bottom, and with a rectangular gap shape 4201, thus it is referred to as 'rectangular'.

Figure 39:
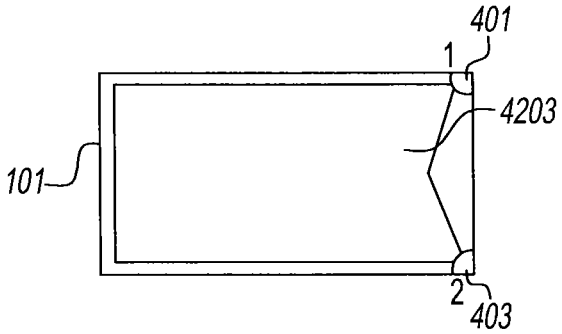
FIG. 39 shows an alternative frame antenna with two parallel feeds and a triangular gap shape.

FIG. 39 shows a two feed frame antenna 101 with two parallel feeds at the bottom, and with a triangular gap shape 4203, thus it is referred to as 'triangle'.

Figure 40:
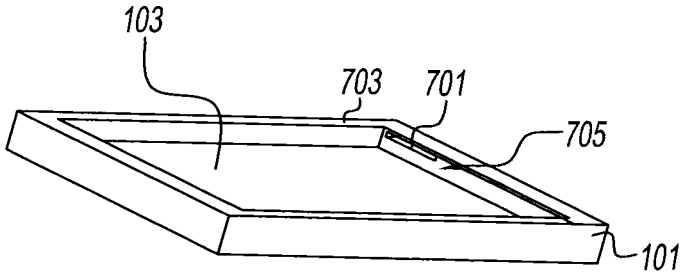
FIG. 40 is a perspective view of a frame antenna having a single capacitive feed configuration.

FIG. 40 show an analysis layout and results of the embodiment of the frame antenna as shown in FIG. 1. FIG. 40 shows a perspective view of a one feed 705 frame antenna 101 with added metal and capacitive type feed, respectively. A capacitor 703 of 1 pf is chosen.

Figure 41:
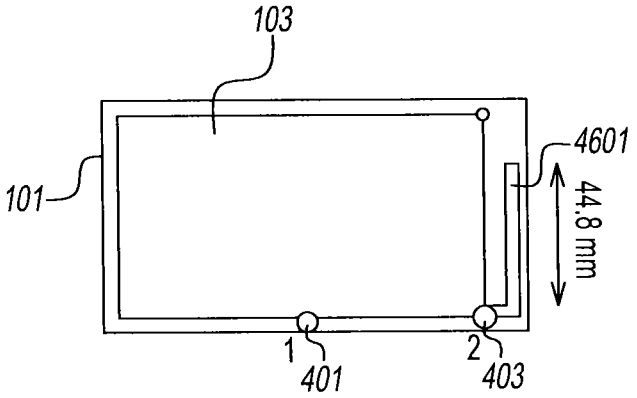
FIG. 41 is another layout of an exemplary frame antenna with a planar capacitive feed element.

FIG. 41 shows a feed type combination analysis layout with a frame antenna 101 with two feeds where port 1 401 is direct feeding while port 2 403 is capacitive feeding (with one feeding element 4601). The opposite is also viable. These combinations may be used to tune the antenna resonances.

Figure 42:
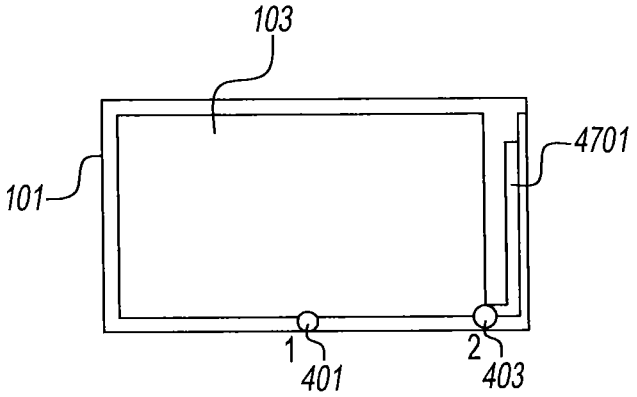
FIG. 42 is another exemplary embodiment with a different planar feed structure.

FIG. 42 shows another embodiment of feed type combination where port 1 401 is direct feeding while port 2 403 is direct feeding with one element before feeding 4701. The opposite is also viable.

Figure 43:
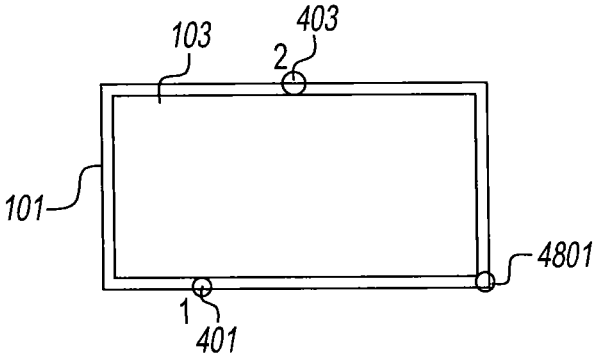
FIG. 43 is an exemplary embodiment of a frame antenna having three feeds.

FIG. 43 shows another embodiment of a three feed frame antenna 101. In addition to the first and second feeds 401, 403, a third feed 4801 is added to increase the design freedom to support various RF circuitry.

Figure 44:
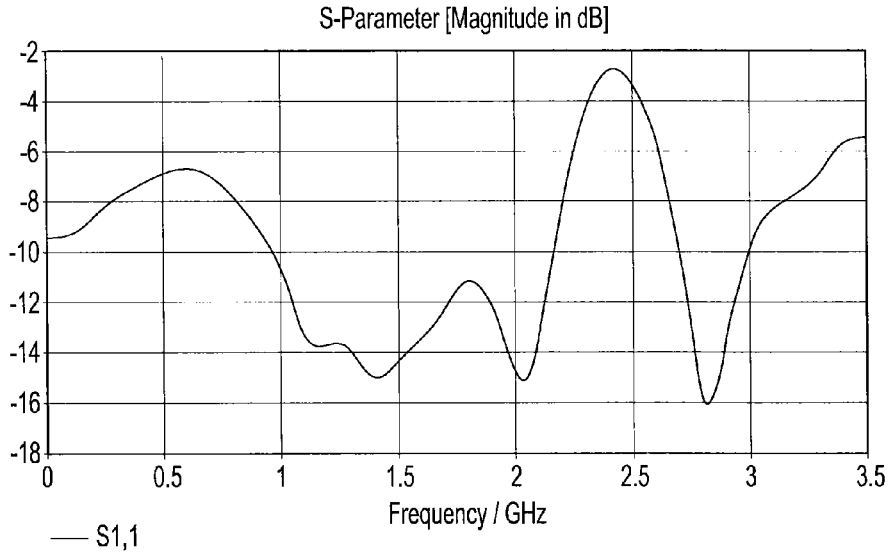
FIG. 44 is an S-parameter graph showing a performance of the first feed point in the embodiment of FIG. 43.

FIG. 44 shows an S-parameter plot of feed 1 of the antenna in FIG. 43.

Figure 45:
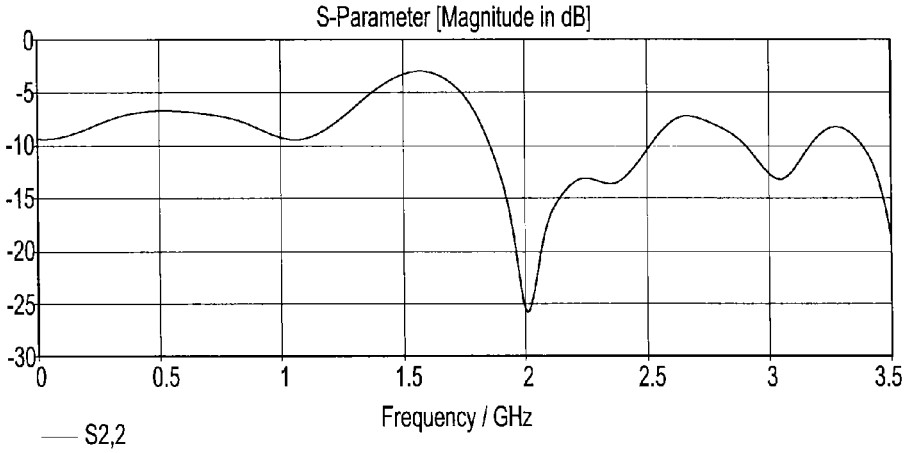
FIG. 45 is another S-parameter graph showing the performance of a second of the three feeds in the embodiment of FIG. 43.

FIG. 45 shows an S-parameter plot of feed 2 of the antenna of FIG. 43.

Figure 46:
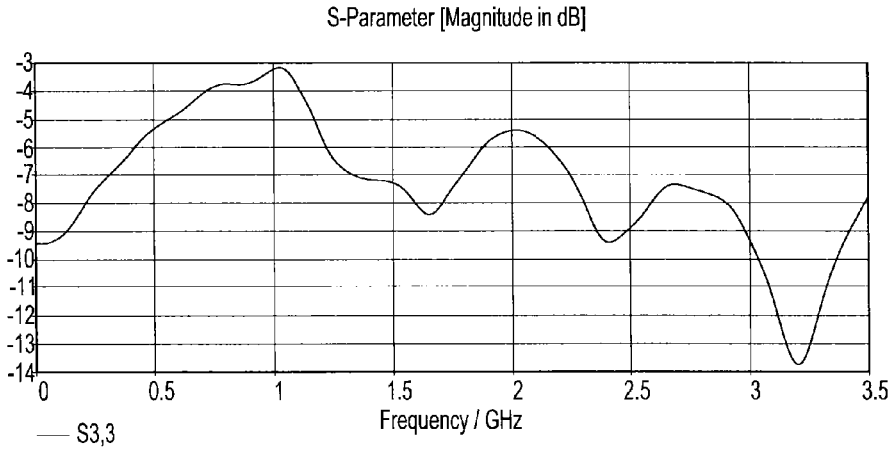
FIG. 46 is another S-parameter chart showing the performance of the third feed of the frame antenna of FIG. 43.

FIG. 46 shows an S-parameter plot of feed 3 of the antenna of FIG. 43.

Figure 47:
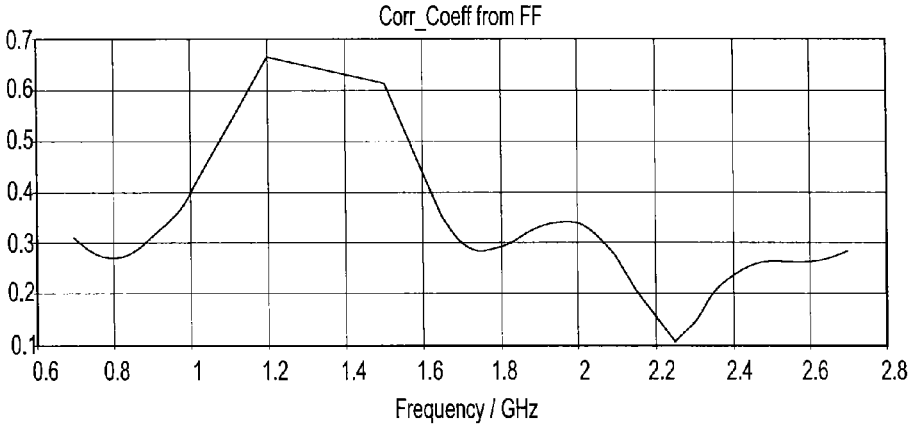
FIG. 47 shows a correlation coefficient of the first and second feeds of the three feed antenna of FIG. 43.

FIG. 47 shows a correlation coefficient plot of feeds 1 and 2 of the antenna of FIG. 43. This figure shows that this antenna design has good performance even with the addition of feed 3.

Figure 48:
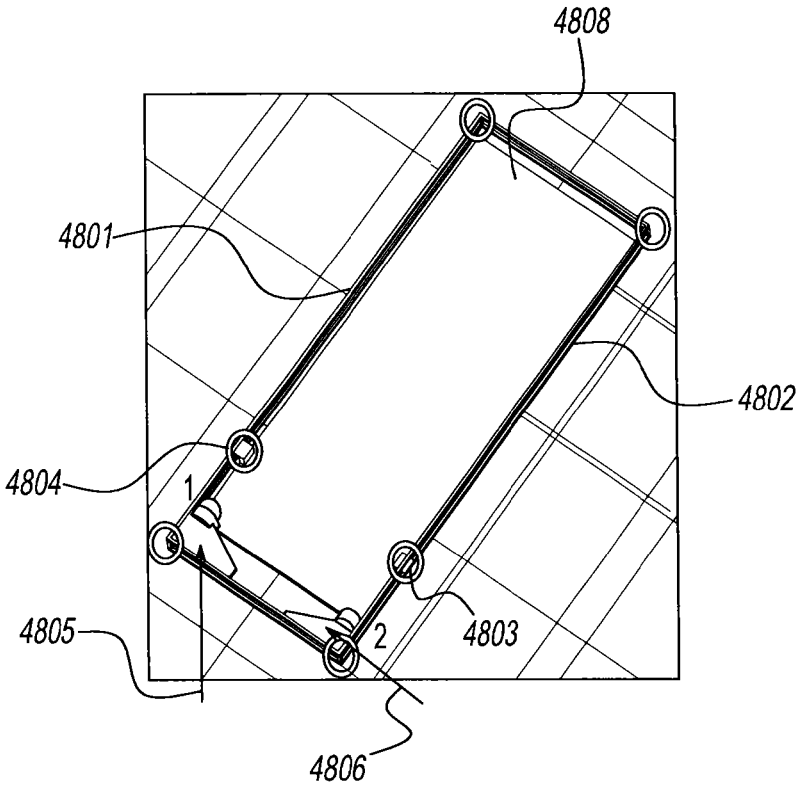
FIG. 48 is another embodiment of a double frame antenna.

FIG. 48 shows a double frame antenna embodiment of the present disclosure. The double-frame antenna is similar to the frame antenna from the earlier embodiments except that instead of one metallic frame it includes a pair of metallic frames. A first frame 4801 is shown to be disposed over a second frame 4802. Each metallic frame forms a continuous conductive loop. Different connections between the two rings are shown at each of the corners. The first metallic frame 4801 is grounded to a display metallic frame 4808 at connection point 4804. Similarly, the second grounding point for the second metallic frame 4802 is at point 4803. A first sub-antenna 4806 is connected to the second ring 4802 in the lower right-hand side of the figure. Similarly, a primary antenna is connected to the first metallic frame 4801 in the lower left-hand corner of the antenna.

The locations where the connections occur control the antenna frequency response and also the frequency and the low coupling. The two metallic frames are electrically shorted to each other at points, such as the corners as shown.

Figure 49:
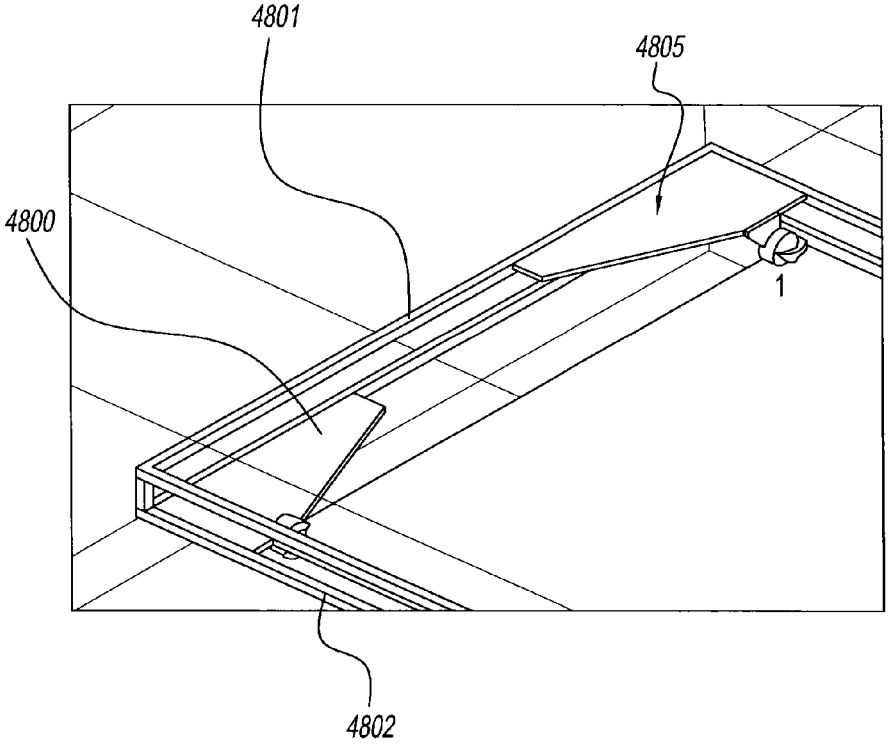
FIG. 49 is a perspective view of the embodiment of FIG. 48, with different feed structures.

FIG. 49 shows an expanded view of the antenna feeds for both the main antenna and the sub-antenna as previously discussed in FIG. 48. Either metallic frame 4801 or 4802 may be electrically shorted to the block 103 (not shown in this figure) via one or more ground connections as previously discussed. This approach results in low envelope correlation coefficient (ECC) of less than 0.2. An ECC of 0.5 or less is considered acceptable by operators and thus provides adequate performance.

Figure 50A:
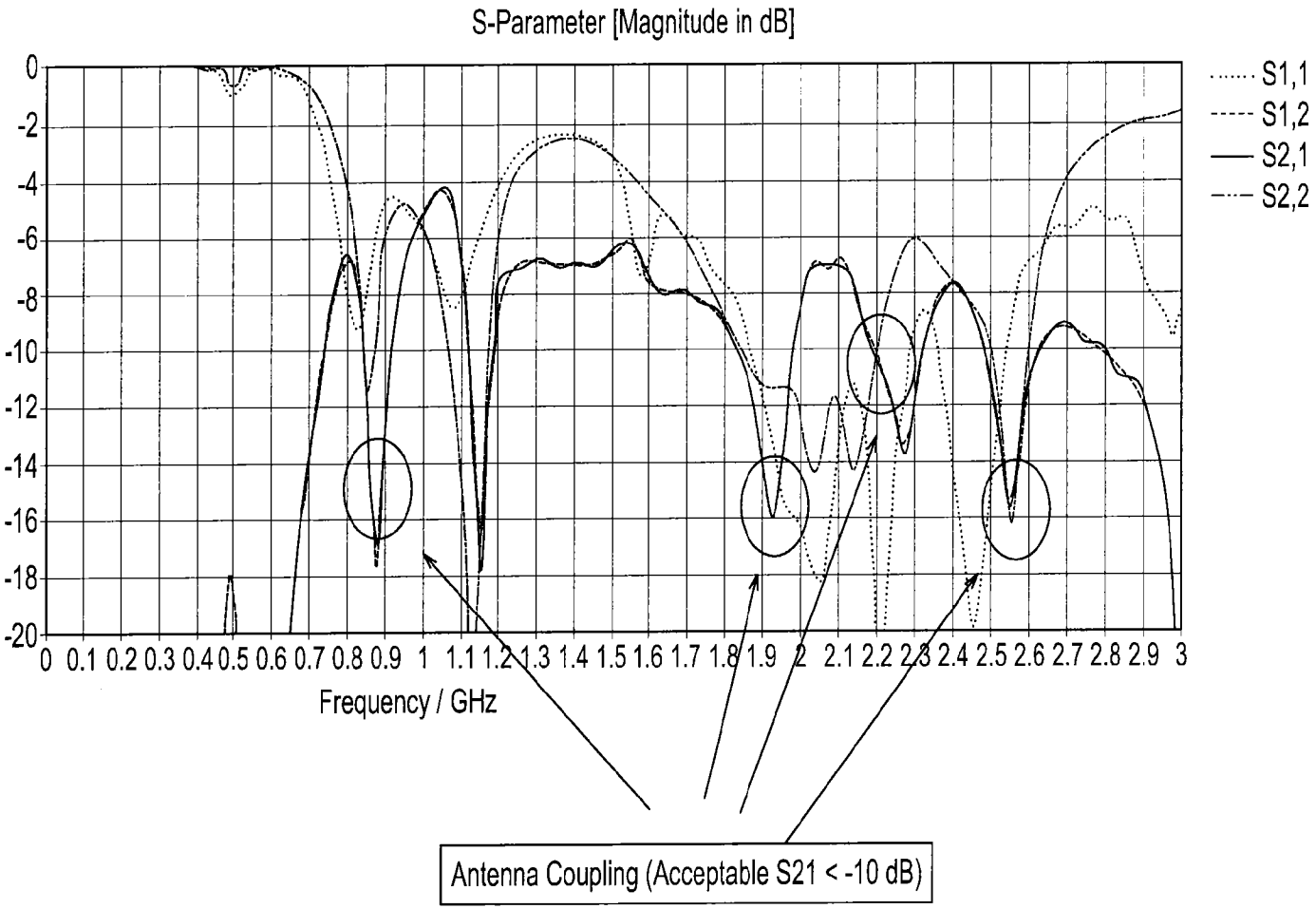
FIGS. 50A and 50B are efficiency graphs of a first and second antenna for the double frame antenna structure.
Figure 50B:
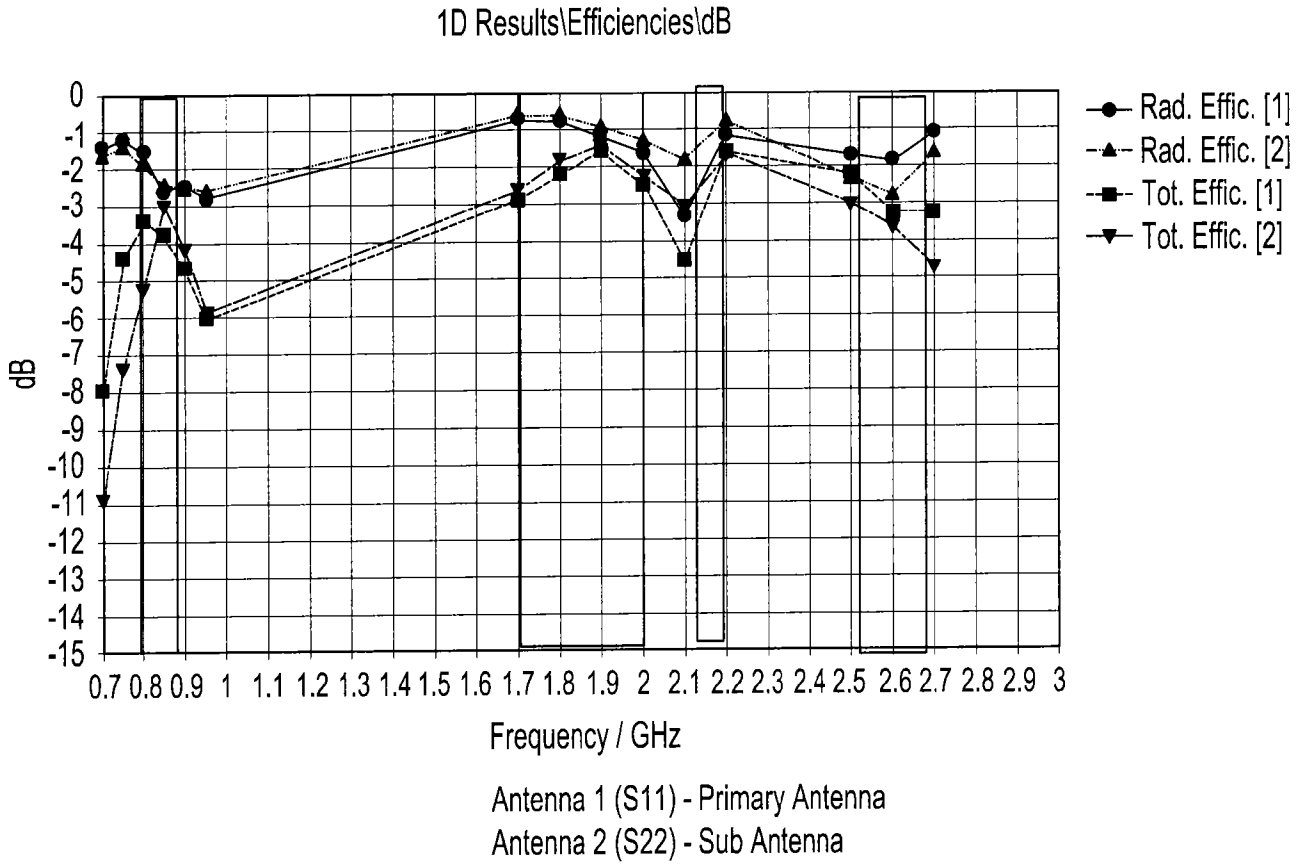

FIGS. 50A and 50B show a radiation of total efficiency for the primary antenna and sub-antenna for the dual frame structure shown in FIG. 48. In terms of the envelope correlation coefficient (ECC), the dual frame antenna performance shown in FIG. 49 is superior, despite the fact that it is very often difficult to obtain a low ECC level in small hand-held devices in the frequency region below 1 GHz. The ECC of this design performs well in the frequency bands of interest, e.g., LTE B5 and B8 (800-900 MHz), LTE B1, B2, B4, B7 (1700-2700 MHz). An acceptable ECC level is 0.5 or less.

Figure 51:
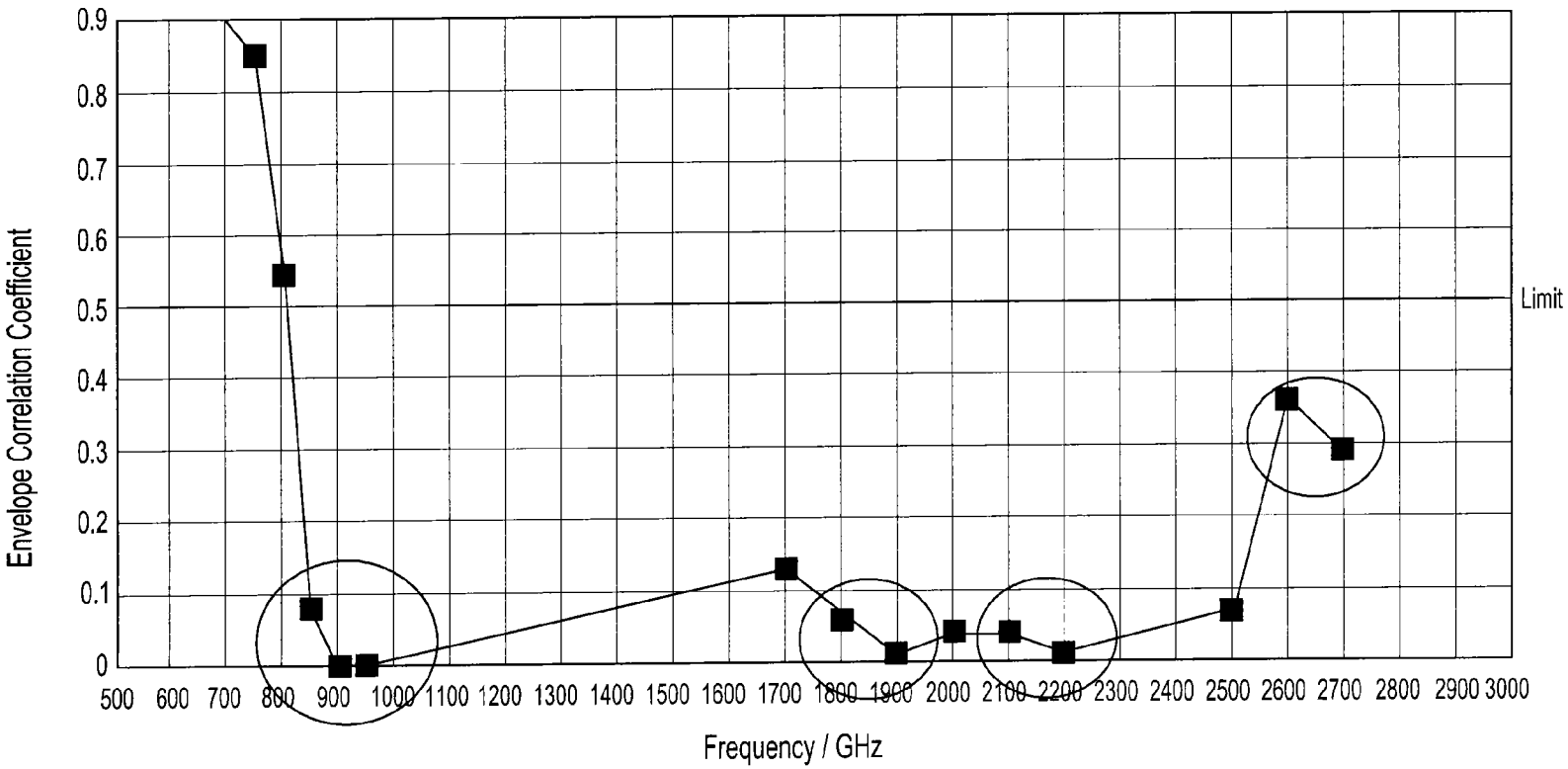
FIG. 51 is an envelope correlation coefficient chart as a function of frequency for the double frame antenna.

FIG. 51 is an envelope correlation coefficient chart as a function of frequency for the double frame antenna.

Figure 52:
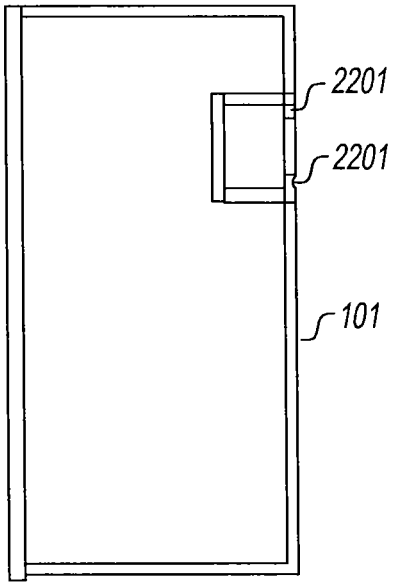
FIG. 52 is an exemplary frame antenna with provisions for a bypass to accommodate ports.

FIG. 52 shows another exemplary embodiment of the metallic frame 101. The metallic frame 101 may have varied shapes and feed points. The metallic frame 101 as shown in the example of FIG. 52 has a bypass shape with nonconductive connections 2201. The bypass shape is used to support other interfaces to provide access to the interior portion of an electronic device while still providing continuity to the metallic frame 101.

According to one embodiment, a frame antenna is described that includes a conductive block having at least one surface-mount electronic component mounted thereon;

a metallic frame having a continuous annular structure with an inner void region, the metallic frame being disposed around a periphery of the conductive block and separated from the conductive block by a predetermined distance, the metallic frame overlapping an edge of an upper surface of the conductive block; and one or more antenna feeds disposed between the metallic frame and the conductive block.

According to one aspect, the metallic frame has an L-shaped cross-section, one side of the L-shaped cross section overlapping the edge of the upper surface of the conductive block, and another side of the L-shaped cross-section overlapping an edge of each side surface of the conductive block.

According to another aspect, the void area is located at an approximate center of the metallic frame.

According to another aspect, the antenna further includes one or more electrically shorted or galvanic connections between the conductive block and the metallic frame, wherein each of the one or more electrically shorted connections is direct or loaded with a capacitor, an inductor, or a matching network, and each of the one or more galvanic connections is direct or loaded with a capacitor, an inductor, or a matching network.

According to another aspect, each of the one or more antenna feeds is one of a metal sheet, and a metal plate that is fed capacitively, inductively, distributively, or directly, and the metal sheet and the metal plate are loaded with a capacitor, an inductor, or a matching network.

According to another aspect, the predetermined distance is at least 0.5 mm.

According to another aspect, the one or more antenna feeds includes a cellular antenna feed and a sub antenna feed.

According to another aspect, the metallic frame has a rectangular shape with a first and a second longer side and a first and a second shorter side, the first and the second longer side being between 100 mm and 140 mm long and the first and the second shorter sides being between 60 mm and 80 mm long;

the cellular antenna feed is placed on the first longer side at not more than 32 mm from a first vertex of the rectangular shape, the first vertex belonging to the first shorter side; and the sub-antenna feed is placed on the second longer side at not more than 62 mm from a second vertex of the rectangular shape, the second vertex belonging to the first shorter side.

According to another aspect, the one or more antenna feeds include a cellular antenna feed and a non-cellular antenna feed.

According to another aspect the metallic frame and the conductive block have a rectangular shape.

According to another aspect the metallic frame has a rectangular shape, and the conductive block has a T shape.

According to another aspect the conductive block has a triangular shape cavity on one side.

According to another aspect the conductive block and the metallic frame form a gap that is wider on one side.

According to another aspect the metallic frame and the conductive block are electrically shorted to each other along an extended part of the gap.

According to another aspect the frame antenna is used in combination with a conventional antenna.

According to another embodiment, a frame antenna is described that includes a conductive block having at least one surface-mount electronic component mounted thereon;

a first metallic frame having a continuous annular structure with an inner void region, the metallic frame being disposed around a periphery of the conductive block and separated from the conductive block by a predetermined distance, the metallic frame overlapping an edge of an upper surface of the conductive block;

a second metallic frame having a continuous annular structure with a void area; and one or more antenna feeds disposed between the metallic frame and the conductive block.

According to one aspect one or more antenna feeds are placed between the metallic frame, the second metallic frame, and the conductive block.

According to another aspect the antenna includes one or more electrically shorted or galvanic connections between the conductive block, the metallic frame, and the second metallic frame, wherein each of the one or more electrically shorted connections is direct or loaded with a capacitor, an inductor, or a matching network, and each of the one or more galvanic connections is direct or loaded with a capacitor, an inductor, or a matching network.

According to another aspect the antenna includes a conventional antenna disposed on the block and used in combination with a conventional antenna.

Obviously, numerous modifications and variations of the present invention are possible in light of the above teachings. It is therefore to be understood that within the scope of the appended claims, the invention may be practiced otherwise than as specifically described herein.

The invention claimed is:

1. A frame antenna comprising:

a conductive block having at least one surface-mount electronic component mounted thereon;

a metallic frame having a continuous annular structure with an inner void region, the metallic frame being disposed around a periphery of the conductive block and separated from the conductive block by a predetermined distance, the metallic frame overlapping an edge of an upper surface of the conductive block; and one or more antenna feeds disposed between the metallic frame and the conductive block.

2. The frame antenna of claim 1, wherein the metallic frame has an L-shaped cross-section, one side of the L-shaped cross section overlapping the edge of the upper surface of the conductive block, and another side of the L-shaped cross-section overlapping an edge of each side surface of the conductive block.

3. The frame antenna of claim 1, wherein the inner void region is located at an approximate center of the metallic frame.

4. The frame antenna of claim 1, further comprising:

one or more electrically shorted or galvanic connections between the conductive block and the metallic frame, wherein each of the one or more electrically shorted connections is direct or loaded with a capacitor, an inductor, or a matching network, and each of the one or more galvanic connections is direct or loaded with a capacitor, an inductor, or a matching network.

5. The frame antenna of claim 1, wherein each of the one or more antenna feeds is one of a metal sheet, and a metal plate that is fed capacitively, inductively, distributively, or directly, and the metal sheet and the metal plate are loaded with a capacitor, an inductor, or a matching network.

6. The frame antenna of claim 1, wherein the predetermined distance is at least 0.5 mm.

7. The frame antenna of claim 1, wherein the one or more antenna feeds includes a cellular antenna feed and a sub antenna feed.

8. The frame antenna of claim 7, wherein the metallic frame has a rectangular shape with a first and a second longer side and a first and a second shorter side, the first and the second longer side being between 100 mm and 140 mm long and the first and the second shorter sides being between 60 mm and 80 mm long;

the cellular antenna feed is placed on the first longer side at not more than 32 mm from a first vertex of the rectangular shape, the first vertex belonging to the first shorter side; and the sub-antenna feed is placed on the second longer side at not more than 62 mm from a second vertex of the rectangular shape, the second vertex belonging to the first shorter side.

9. The frame antenna of claim 1, wherein the one or more antenna feeds include a cellular antenna feed and a non-cellular antenna feed.

10. The frame antenna of claim 1, wherein the metallic frame and the conductive block have a rectangular shape.

11. The frame antenna of claim 1, wherein the metallic frame has a rectangular shape, and the conductive block has a T shape.

12. The frame antenna of claim 1, wherein the conductive block has a triangular shape cavity on one side.

13. The frame antenna of claim 1, wherein the conductive block and the metallic frame form a gap that is wider on one side.

14. The frame antenna of claim 1, wherein the metallic frame and the conductive block are electrically shorted to each other along an extended part of the gap.

15. The frame antenna of claim 1, wherein the frame antenna is used in combination with a conventional antenna.

16. A frame antenna comprising:

a conductive block having at least one surface-mount electronic component mounted thereon;

a first metallic frame having a continuous annular structure with an inner void region, the metallic frame being disposed around a periphery of the conductive block and separated from the conductive block by a predetermined distance, the metallic frame overlapping an edge of an upper surface of the conductive block;

a second metallic frame having a continuous annular structure with a void area; and one or more antenna feeds disposed between the metallic frame and the conductive block.

17. The frame antenna of claim 16, wherein one or more antenna feeds are placed between the metallic frame, the second metallic frame, and the conductive block.

18. The frame antenna of claim 16 further comprising:

one or more electrically shorted or galvanic connections between the conductive block, the metallic frame, and the second metallic frame, wherein each of the one or more electrically shorted connections is direct or loaded with a capacitor, an inductor, or a matching network, and each of the one or more galvanic connections is direct or loaded with a capacitor, an inductor, or a matching network.

19. The frame antenna of claim 16 further comprising:

a conventional antenna disposed on the block and used in combination with a conventional antenna.

* * * * *